US009563168B2

(12) United States Patent
Fukuda

(10) Patent No.: US 9,563,168 B2
(45) Date of Patent: Feb. 7, 2017

(54) IMAGE FORMING APPARATUS

(71) Applicant: Oki Data Corporation, Tokyo (JP)

(72) Inventor: Masahiro Fukuda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/722,200

(22) Filed: May 27, 2015

(65) Prior Publication Data

US 2015/0346678 A1 Dec. 3, 2015

(30) Foreign Application Priority Data

May 30, 2014 (JP) ..... 2014-112236
Mar. 31, 2015 (JP) ..... 2015-71012

(51) Int. Cl.
*G03G 21/16* (2006.01)

(52) U.S. Cl.
CPC ..... *G03G 21/1633* (2013.01)

(58) Field of Classification Search
USPC ..... 399/110
See application file for complete search history.

(56) References Cited

U.S. PATENT DOCUMENTS 5,978,626 A * 11/1999 Nagamine ..... G03G 21/1628 399/110
8,208,834 B2 * 6/2012 Yamaguchi ..... G03G 21/1628 399/125
2009/0142092 A1 * 6/2009 Sato ..... G03G 21/1846 399/111
2009/0162091 A1 * 6/2009 Yokoi ..... G03G 15/04054 399/90
2009/0169261 A1 * 7/2009 Yokoi ..... G03G 21/1619 399/220
2010/0021200 A1 * 1/2010 Kato ..... G03G 21/1647 399/111
2013/0315625 A1 * 11/2013 Fujita ..... G03G 21/1666 399/125
2014/0064781 A1 * 3/2014 Hashimoto ..... G03G 21/1666 399/110
2014/0252715 A1 * 9/2014 Minoshima ..... B65H 1/04 271/109

FOREIGN PATENT DOCUMENTS

JP 2001-209220 A 8/2001

* cited by examiner

*Primary Examiner* — Clayton E LaBalle
*Assistant Examiner* — Linda B Smith
(74) *Attorney, Agent, or Firm* — Panitch Schwarze Belisario & Nadel LLP

(57) ABSTRACT

An image forming apparatus includes a cover configured to pivot about a shaft to open and close, and a mechanism that includes a movable member and a supporting mechanism. The movable member longitudinally extends in a direction at an angle with the shaft, and includes a first longitudinal end portion and a second longitudinal end portion, the first longitudinal end portion being closer to the shaft than the second longitudinal end portion. The supporting mechanism is mounted on the cover and supports the movable member so that the movable member is movable relative to the cover toward and away from the shaft. When an external force pushes the second longitudinal end portion toward the shaft, the movable member moves to a first position, and when the external force is removed, the movable member returns.

15 Claims, 25 Drawing Sheets

FIG. 5A
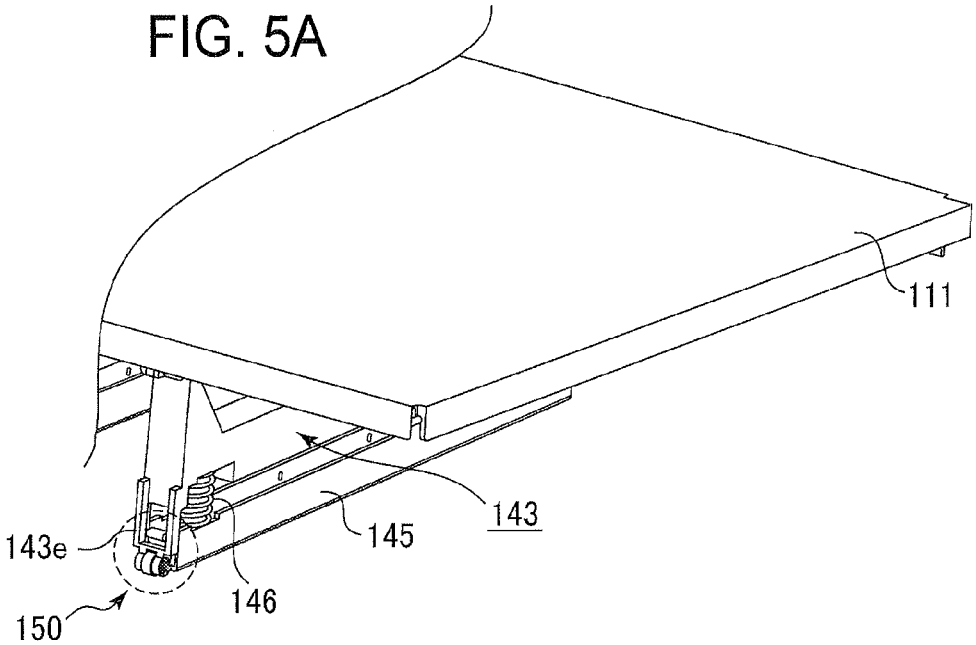
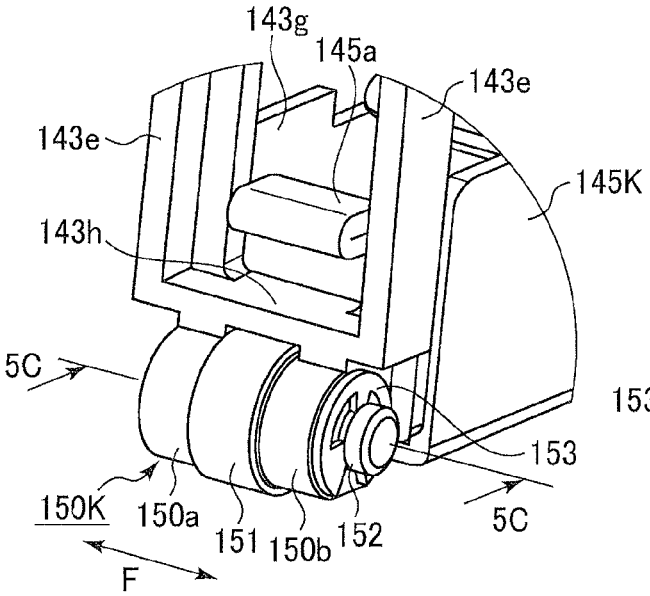
FIG. 5B
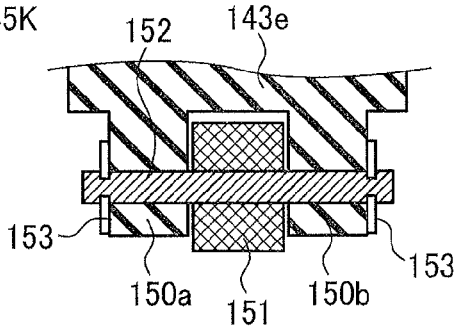
FIG. 5C

FIG. 20A
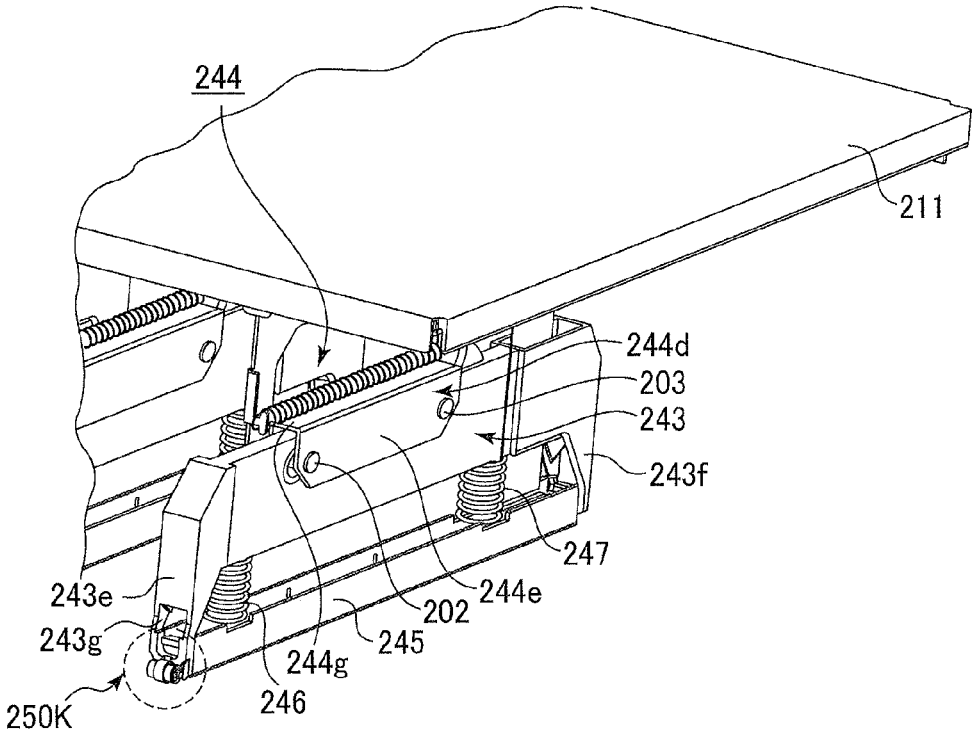
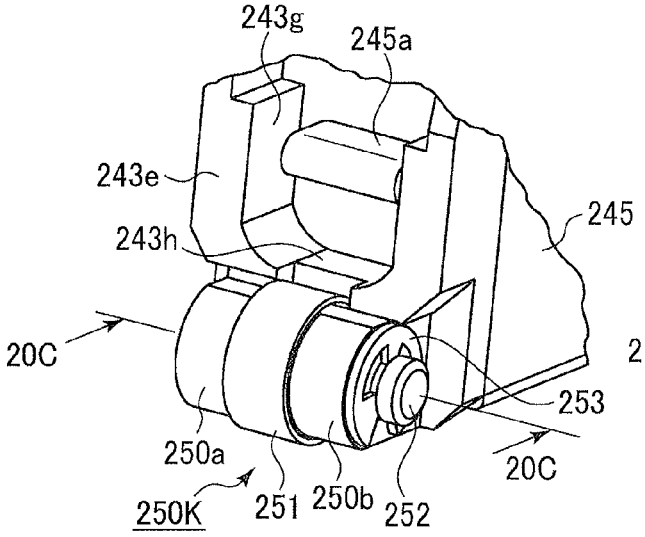
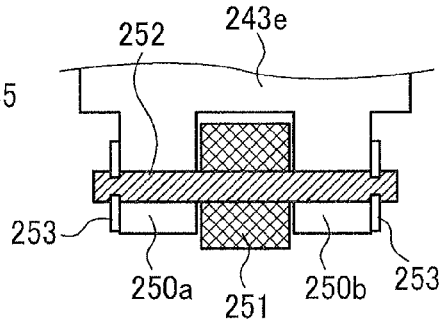
FIG. 20B
FIG. 20C

IMAGE FORMING APPARATUS

BACKGROUND OF THE INVENTION

Field of the Invention

The present invention relates to an electrophotographic image forming apparatus, and more particularly to a mechanism for opening and closing the top cover of an electrophotographic image forming apparatus.

Description of the Related Art

Japanese Patent Application Laid-Open No. 2001-209220 discloses an electrophotographic image forming apparatus that employs a configuration in which LED heads are secured to an openable cover. When a user mounts the LED heads on the image forming apparatus or dismounts the LED heads from the image forming apparatus, he opens the top cover.

This type of image forming apparatus usually requires a large space sufficient for smoothly opening and closing of the top cover without interfering with surrounding structural elements in the image forming apparatus, which are obstacles to achieving a compact apparatus.

SUMMARY OF THE INVENTION

The present invention was made to solve the aforementioned drawbacks.

An object of the present invention is to provide an image forming apparatus that requires only a small space when a cover with LED heads mounted thereon is opened and closed relative to the image forming apparatus.

An image forming apparatus includes a cover configured to pivot about a shaft to open and close, and a mechanism that includes a movable member and a supporting mechanism. The movable member longitudinally extends in a direction at an angle with the shaft, and includes a first longitudinal end portion and a second longitudinal end portion, the first longitudinal end portion being closer to the shaft than the second longitudinal end portion. The supporting mechanism is mounted on the cover and supports the movable member so that the movable member is movable relative to the cover toward and away from the shaft. When an external force pushes the second longitudinal end portion toward the shaft, the movable member moves to a first position, and when the external force is removed, the movable member returns to its reference position.

Further scope of applicability of the present invention will become apparent from the detailed description given hereinafter. However, it should be understood that the detailed description and specific examples, while indicating preferred embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and wherein:

FIG. 5A is a partial perspective view of a roller assembly, illustrating the configuration of the roller assembly;

FIG. 5B is an expanded perspective view of a pertinent portion of the configuration shown in FIG. 5A;

FIG. 5C is a cross-section view taken along a line 5C-5C in FIG. 5B;

FIG. 20A is a partial perspective view of the roller assembly, which is supported at a tip portion of the left extended portion;

FIG. 20B is an expanded perspective view of a pertinent portion of the configuration shown in FIG. 20A;

FIG. 20C is a cross-section view taken along a line 20C-20C in FIG. 20B;

DETAILED DESCRIPTION OF THE INVENTION

By way of preferred embodiments, the present invention will be described in detail with reference to the accompanying drawings.

First Embodiment

Figure 1:
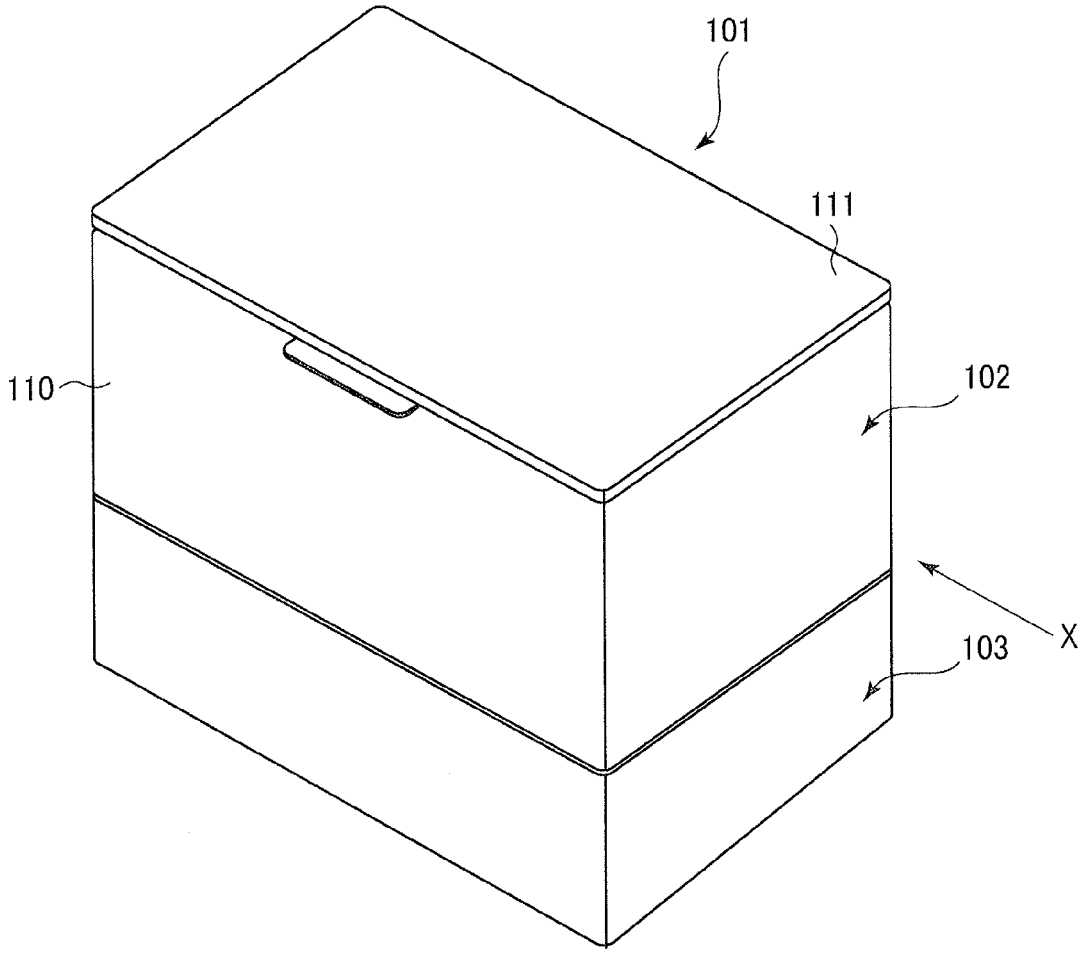
FIG. 1 is a perspective view of an image forming apparatus according to a first embodiment.
Figure 2:
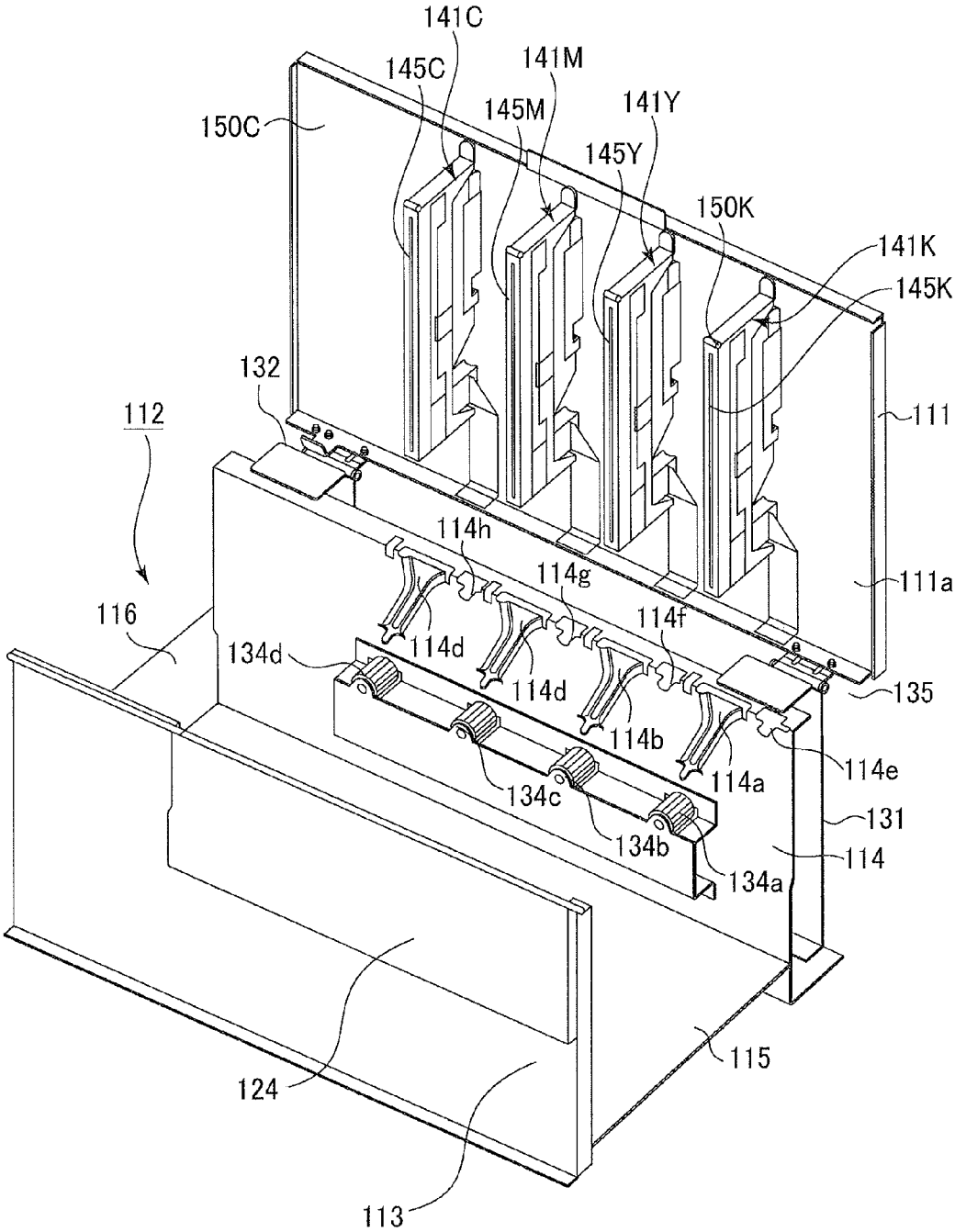
FIG. 2 is a perspective view of a body and a top cover that is pivotally mounted on the body.
Figure 3:
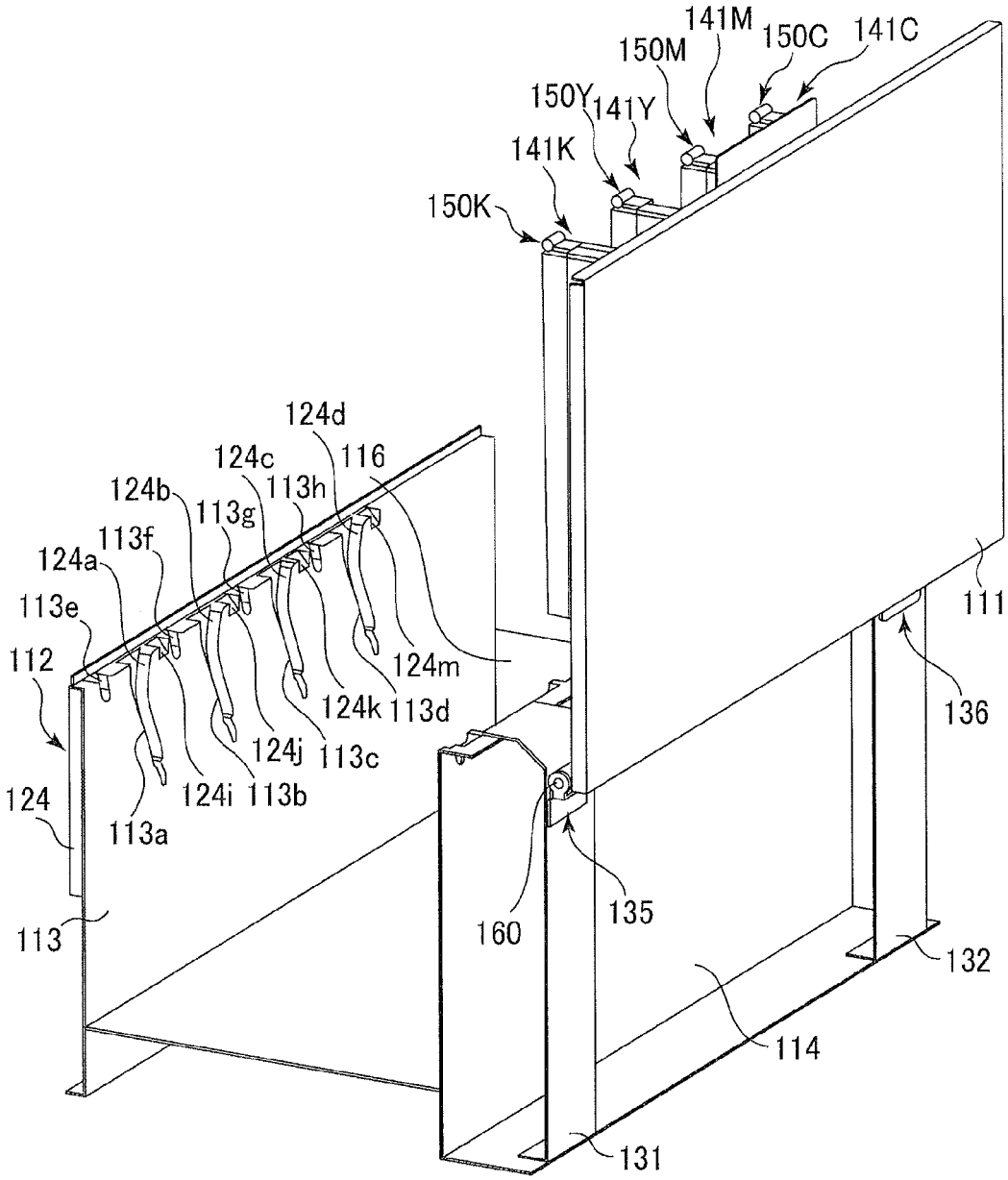
FIG. 3 is a perspective view of the body and the top cover as seen in another direction.

FIG. 1 is a perspective view of an image forming apparatus 101 according to a first embodiment. FIG. 2 is a perspective view of a chassis 112 and a top cover 111 that is pivotally mounted on the chassis 112. FIG. 3 is a perspective view of the chassis 112 and the top cover 111 as seen in another direction.

Referring to FIG. 1, the image forming apparatus 101 includes a printing section 102 disposed on a paper cassette 103. The printing section 102 prints on a sheet of recording paper 125 (FIG. 15) supplied from the paper cassette 103, and discharges the printed recording paper 125 onto a stacker.

Referring to FIGS. 2 and 3, the printing section 102 includes a housing 110 that accommodates the chassis 112. The chassis 112 includes a left frame 113, a right frame 114, a bottom frame 115, and a rear frame 116. The left frame 113 and right frame 114 are parallel to each other, and rise from the bottom frame 115. The rear frame 116 rises from the bottom frame 115, and is positioned between the left and right frames 113 and 114.

Referring to FIG. 3, the left frame 113 is formed with long, tapered cutouts 113*a*, 113*b*, 113*c*, and 113*d* aligned at equal intervals. The cutouts 113*a*, 113*b*, 113*c*, and 113*d* extend obliquely downward from the top of the left frame 113. When the top cover 111 is closed, the cutouts 113*a*, 113*b*, 113*c*, and 113*d* guide lower left projections 172K, 172Y, 172M, and 172C (FIG. 6) of image forming units 171K, 171Y, 171M, and 171C to corresponding mounting positions, respectively.

The left frame 113 is also formed with engagement portions 113*e*, 113*f*, 113*g*, and 113*h* which are adjacent to the cutouts 113*e*, 113*f*, 113*g*, and 113*h*, respectively. The engagement portions 113*e*, 113*f*, 113*g*, and 113*h* receive upper left projections 173K, 173Y, 173M, and 173C (FIG. 6), respectively.

A guide plate 124 is fixedly mounted on the outer surface of the left frame 113, and is formed with guide grooves 124*a*, 124*b*, 124*c*, and 124*d* in communication with the cutouts 113*a*, 113*b*, 113*c*, and 113*d*, respectively. The guide grooves 124*a*, 124*b*, 124*c*, and 124*d* and cutouts 113*a*, 113*b*, 113*c*, and 113*d* cooperate to guide the projections 173K, 173Y, 173M, and 173C of the image forming units 171K, 171Y, 171M, and 171C, respectively. The guide plate 124 is also formed with grooves in communication with the engagement portions 113*e*, 113*f*, 113*g*, and 113*h*, respectively.

The right frame 114 is formed with tapered guide grooves 114*a*, 114*b*, 114*c*, and 114*d* that guide projections 174K, 174Y, 174M, and 174C (FIG. 7) of the image forming units 171K, 171Y, 171M, and 171C. The guide grooves 114*a*, 114*b*, 114*c*, and 114*d* extend obliquely downward from the top of the right frame 114. The right frame 114 is also formed with engagement portions 114*e*, 114*f*, 114*g*, and 114*h* that receive the upper right projections 175K, 175Y, 175M, and 175C (FIG. 7) of the image forming units 171K, 171Y, 171M, and 171C.

Referring back to FIG. 2, gears 134*a*, 134*b*, 134*c*, and 134*d* are disposed under the guide grooves 114*a*, 114*b*, 114*c*, and 114*d*, respectively, and drive corresponding rotatable structures, which will be described later, of the image forming units 171K, 171Y, 171M, and 171C.

A pair of U-shaped supporting plates 131 and 132 extend vertically, and are secured to the right frame 114 from the outer side. Each of the supporting plates 131 and 132 is disposed at a longitudinal end portion of the right frame 114. The top cover 111 is pivotally mounted on the right frame 114 by means of hinges 135 and 136. Each of the hinges 135 and 136 includes two hinge leaves and a shaft 160. One of their respective hinge leaves is fixed to the supporting plate 131 or 132, and the other is fixed to the top cover 111.

With the above-described configuration, the top cover 111 is pivotally supported so that the top cover 111 can pivot between a closed position (FIG. 1) and an open position (FIG. 2) through an angle of about 90 degrees. The pivot shafts 160 (FIGS. 3 and 4) of the top cover 111 are substantially parallel to the right frame 114, and are in line with each other.

The top cover 111 includes an LED head unit 141K for black (K) images, an LED head unit 141Y for yellow (Y) images, an LED head unit 141M for magenta (M) images, and an LED head unit 141C for cyan (C) images, which are mounted on the inner surface 111*a* of the top cover 111 and serve as exposing units. Each LED head unit includes a support 142, a link 144, a tension coil spring 148, a head holder 143, and a corresponding LED head.

The black head unit 141K, yellow head unit 141Y, magenta head unit 141M, and cyan head unit 141C include a black (K) LED head 145K, a yellow (Y) LED head 145Y, a magenta (M) LED head, and a cyan (C) LED head 145C, respectively, which are mounted on the free ends of the black head unit 141K, yellow head unit 141Y, magenta head unit 141M, and cyan head unit 141C. The LED heads 145K, 145Y, 145M, and 145C extend in their longitudinal directions substantially perpendicular to the axes of the pivot shafts 160 of the top cover 111 so that one longitudinal end of an LED head is closer to the axes of the shafts 160 than the other longitudinal end of the LED head. Thus, the lines of light emitting diodes (LEDs) of the LED heads 145K, 145Y, 145M, and 145C extend in directions substantially perpendicular to the axes of the pivot shafts 160.

The LED head units 141K, 141Y, 141M, and 141C include roller assemblies 150K, 150Y, 150M, and 150C, respectively, at one of their respective free end corners. The guide plate 124 is formed with four inclined surfaces 124*i*, 124*j*, 124*k*, and 124*m* which receive the roller assemblies 150K, 150Y, 150M, and 150C, respectively. The left frame 113 is formed with four cutouts 113*i*, 113*j*, 113*k*, and 113*m* (FIG. 7), which are in alignment with the inclined surfaces 124*i*, 124*j*, 124*k*, and 124*m* and receive the roller assemblies 150K, 150Y, 150M, and 150C, respectively.

Figure 4:
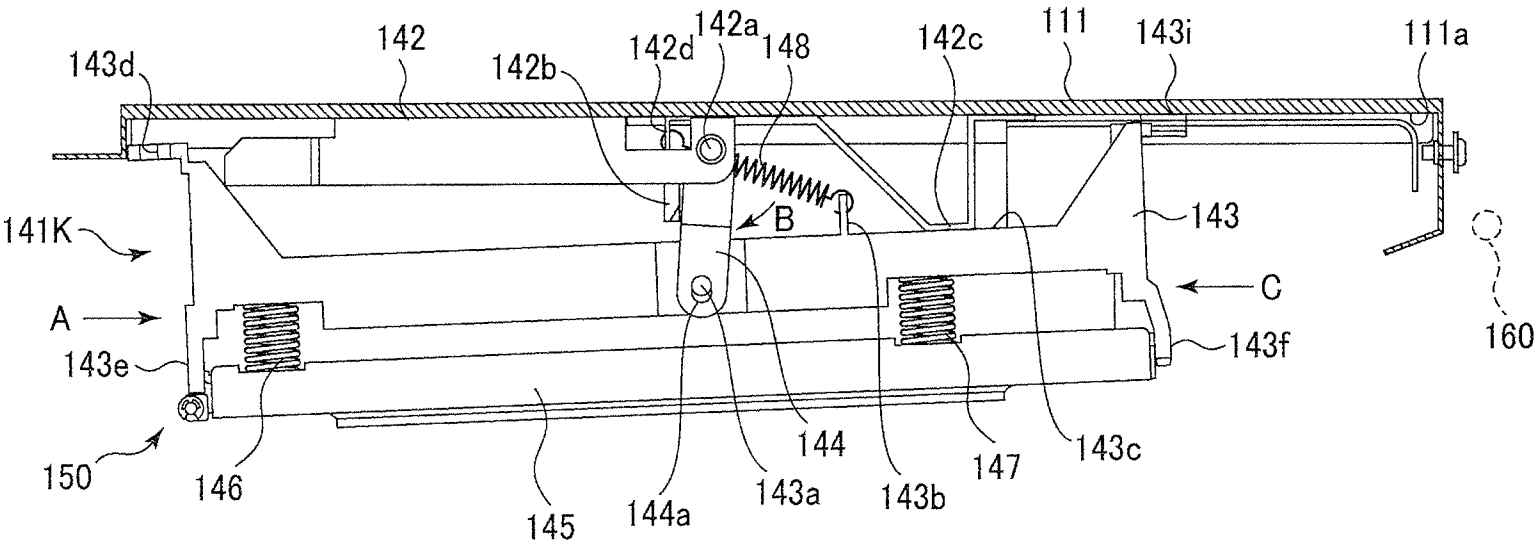
FIG. 4 is a view of the top cover and an LED head unit as seen in a direction shown by arrow X in FIG. 1 when the top cover is at the closed position.

The LED head units 141K, 141Y, 141M, and 141C are identical in construction and the description thereof will be confined to the LED head unit 141K. FIG. 4 is a view of the top cover 111 and the LED head unit 141K as seen in a direction shown by arrow X in FIG. 1 when the top cover 111 is at the closed position.

Referring to FIG. 4, the support 142 includes a bearing portion 142*a*, a stopper 142*b*, a hook 142*d*, and an abutment portion 142*c*. The support 142 is secured to the inner surface 111*a* of the top cover 111. The link 144 is swingably supported by the bearing portion 142*a* of the support 142, and includes an elongate hole 144*a* formed at one longitudinal end portion thereof. The elongate hole 144*a* extends or being elongated in a longitudinal direction of the link 144. The stopper 142*b* limits pivotal motion of the link 144 in a clockwise direction in FIG. 4. One of two end portions of the tension coil spring 148 is hooked on the hook 142*d*, and the other is hooked on another hook 143*b*. The abutment portion 142*c* is formed at a location closer to the shaft 160 than the bearing portion 142*a*, and is spaced from the top cover 111. The abutment portion 142*c* abuts a head holder 143 at a projection 143*c* so that the head holder 143 is movable in a substantially straight direction parallel to the top cover 111.

The support 142 and link 144 constitute a holder supporting mechanism, which holds the head holder 143. The head holder 143 in turn holds the heads 145K, 145Y, 145M, and 145C.

The head holder 143 extends in a longitudinal direction thereof substantially perpendicular to the shafts 160, and includes the projection 143*a* formed at a substantially midway point of the length of the head holder 143. The projection 143*a* loosely fits in the elongate hole 144*a* such that the head holder 143 is pivotally connected to the link 144 via the projection 143*a*. The head holder 143 also includes the hook 143*b* and an abutment portion 143*c*. The hook 143*b* is located closer to the axes of the pivot shafts 160 than the projection 143*a*, and projects from the head holder 143 toward the support 142. The abutment portion 143*c* abuts the abutment portion 142*c* at a position between the hook 143*b* and the axes of the pivot shafts 160.

Alternatively, the head holder 143 may be formed to abut a projection 143*i* instead of the abutment portion 142*c*.

The tension coil spring 148 pulls the hook 143*b* obliquely toward the support 142, so that the link 144, which supports the head holder 143, abuts the stopper 142*b*. The stopper 142*b* prevents the link 144 from swinging in a direction shown by arrow B, thereby inhibiting movement of the head holder 143 in a direction shown by arrow C. Also, the abutment portion 143*c* abuts the abutment portion 142*c*, preventing the head holder 143 from moving against the abutment portion 142*c*.

In FIG. 4, the bearing portion 142*a* and an elongate hole 144*a* lie in a plane substantially perpendicular to the top cover 111, and the head holder 143 longitudinally extends in a direction substantially parallel to the top cover 111. The position of the head holder 143, shown in FIG. 4, relative to the top cover 111 is referred to as a reference position in the first embodiment.

In FIG. 4, when an external force acting in a direction shown by arrow A is applied to the head holder 143, the head holder 143 slightly moves in the A direction against the spring force of the tension coil spring 148. The link 144 leaves the stopper 142*b*, and pivots about the bearing portion 142*a* in a direction opposite to the B direction, while the abutment portion 143*c* slides on the abutment portion 142*c* toward the axes of the shafts 160.

When the external force in the A direction is removed, the head holder 143 automatically returns to the reference position due to the urging force of the tension spring 148. As described above, the head holder 143 longitudinally extends parallel to a plane perpendicular to the axes of the pivot shafts 160, and is configured to move toward and away from the axes of the pivot shafts 160.

The head holder 143 includes a left leg 143*e* at one longitudinal end thereof and a right extended portion 143*f* at the other longitudinal end. The left leg 143*e* extends downward away from the top cover 111, and the right extended portion 143*f* extends downward away from the top cover 111. The left leg 143*e* and right extended portion 143*f* each include a vertically extending groove 143*g* (FIG. 5B). The left leg 143*e* and right extended portion 143*f* cooperate to loosely hold longitudinal end portions of the LED head 145K in position, so that the LED head 145K extends in a direction substantially parallel to the longitudinal direction of the head holder 143. Thus, the rectangular LED head 145K lies in the plane perpendicular to the axes of the pivot shafts 160.

Thus, when the top cover 111 is pivoted from the closed position to the open position, the LED heads 145K, 145Y, 145M, and 145C move together with the cop cover 111. This minimizes the chance of the LED heads 145K, 145Y, 145M, and 145C interfering with the image forming units 171K, 171Y, 171M, and 171C when the user mounts or dismounts the image forming units 171K, 171Y, 171M, and 171C.

The head holder 143 includes a positioning hole 143*d*, which fits over a positioning post 113*p* (FIG. 12-14) formed on the left frame 113.

FIG. 5A is a partial perspective view of the roller assembly 150K, illustrating the configuration of the roller assembly 150K, which is supported at a tip portion of the left leg 143*e*. FIG. 5B is an expanded perspective view of a pertinent portion of the configuration shown in FIG. 5A. FIG. 5C is a cross-section view taken along a line 5C-5C in FIG. 5B.

Referring to FIGS. 5A and 5B, the LED head 145K includes a projection 145*a* formed at each longitudinal end portion thereof, the projection 145*a* loosely fitting in the groove 143*g*.

Thus, the LED head 145K is slightly movable in the longitudinal direction perpendicular to the axes of the pivot shafts 160 and in a direction shown by arrow F. A compression coil spring 146 or 147 (FIG. 4) is disposed at each longitudinal end portion, being positioned between the head holder 143 and the LED head 145K, so that the projection 145*a* of the LED head 145K is in pressure contact with a bottom 143*h* of the groove 143*g* when the top cover 111 is completely closed.

Thus, when the top cover 111 has been closed, the LED head 145K is pushed back by the image forming unit 171K against the urging force of the springs 146 and 147, the projection 145*a* of the LED head 145K being raised slightly from the bottom 143*h* as shown in FIG. 5B.

As shown in FIGS. 5B and 5C, the roller assembly 150K includes a roller 151 rotatably mounted on a shaft 152, which in turn is supported by substantially cylindrical bearing members 150*a* and 150*b* and extends in a direction substantially parallel to the axes of the pivot shafts 160. The shaft 152 is formed with a circumferential grooves at its longitudinal end portions. E-rings 153 are mounted to the circumferential grooves, preventing pull-out of the shaft 152. The outer diameter of the roller 151 is larger than that of the bearing members 150*a* and 150*b*, so that the roller 151 extends outwardly than the bearing members 150*a* and 150*b*.

The circumferential surface of the roller 151 projects radially outwardly from the bearing members 150*a* and 150*b*. When the top cover 111 pivots to the closed position (FIGS. 1 and 14), the roller 151 rolls on the inclined surface

124*i* (FIG. 11B), the LED head 145K moving slightly toward the axes of the shafts 160.

Figure 6:
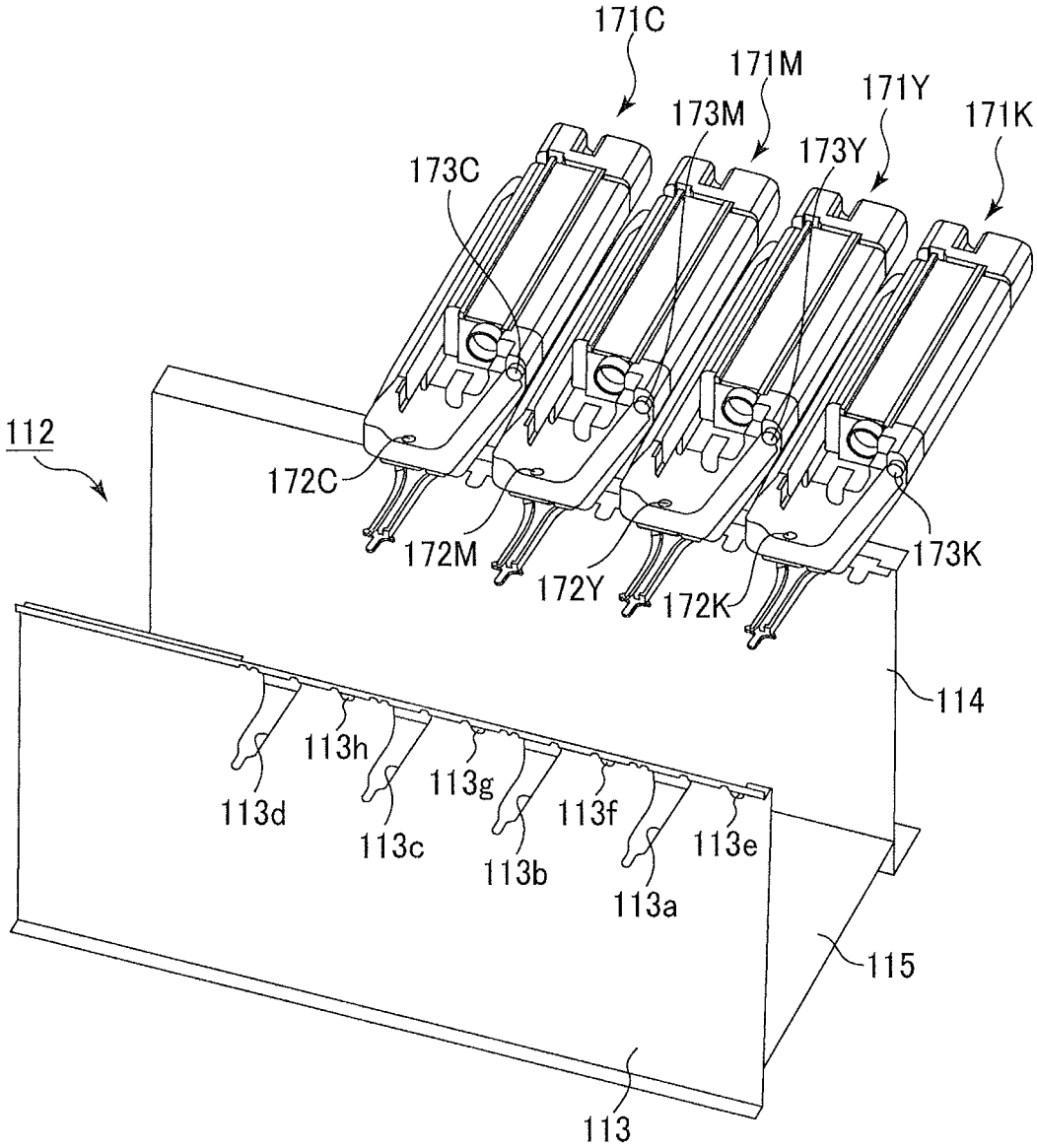
FIG. 6 is a perspective view of image forming units and a chassis.
Figure 7:
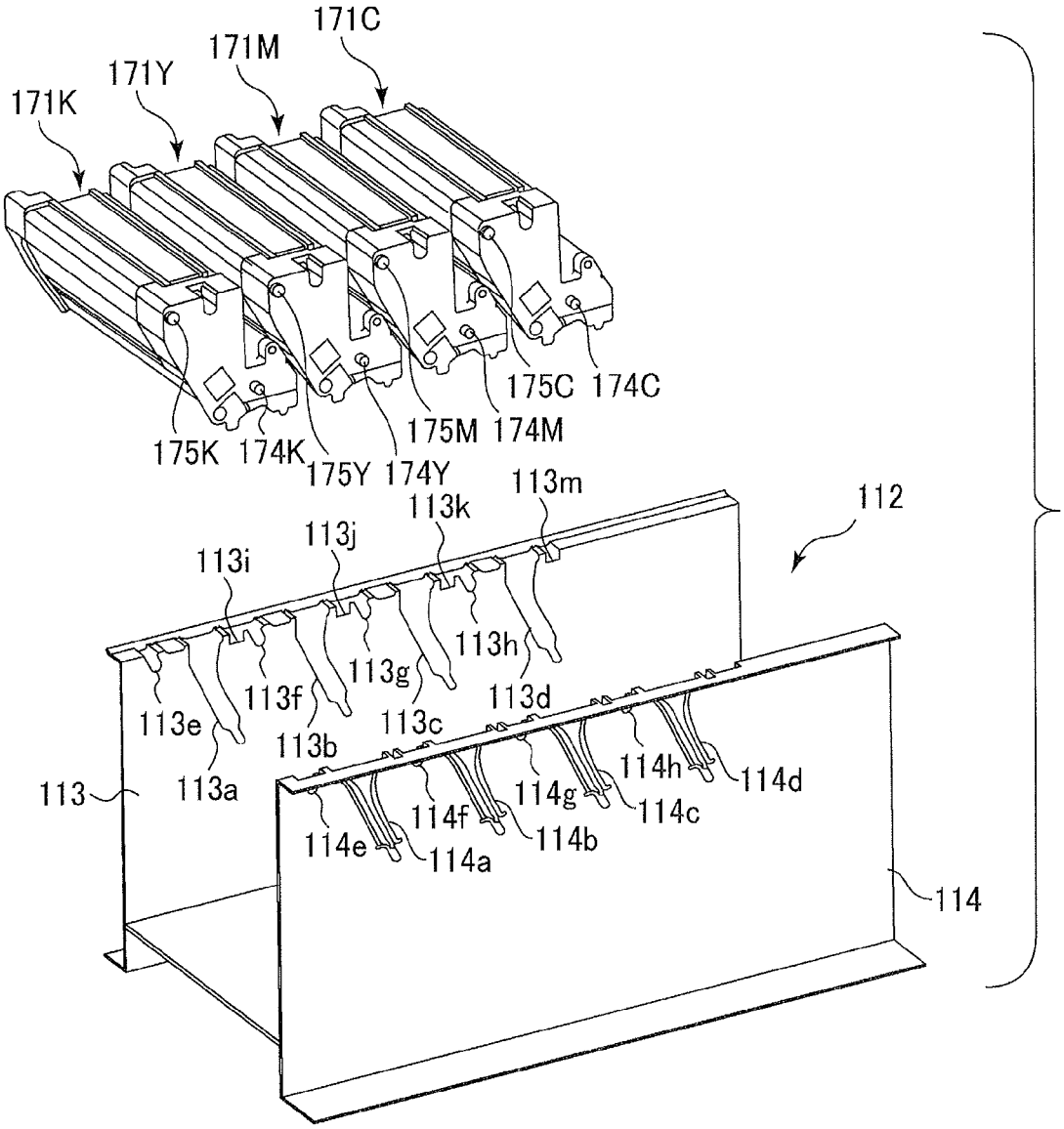
FIG. 7 is another perspective view of the chassis and the image forming units as seen in a direction opposite to FIG. 6.

A description will be given of how the image forming units 171K, 171Y, 171M, and 171C are mounted on the chassis 112. FIG. 6 is a perspective view of the image forming units 171K, 171Y, 171M, and 171C and the chassis 112. The guide plate 124, rear frame 116, and supporting plates 131 and 132 are omitted from FIG. 6 for the sake of simplicity. FIG. 7 is another perspective view of the chassis 112 and the image forming units 171K, 171Y, 171M, and 171C as seen in a direction opposite to FIG. 6. The chassis 112 actually supports a transfer unit 110, a fixing unit 115, a transport roller pair 121 (FIG. 15), but these structural elements have been omitted from FIGS. 6 and 7 for the sake of simplicity.

The image forming units 171K, 171Y, 171M, and 171C are mounted on the chassis 112 in the same way, and therefore a description will be given only of how the image forming unit 171K is mounted. The operator holds the image forming unit 171K over the chassis 112 so that the lower left projection 172K (FIG. 6) faces the left frame 113 and the right lower projection 174K (FIG. 7) faces the right frame 114. The operator then lowers the image forming unit 171K until the lower left projection 172K enters the cutout 113*a*, the right lower projection 174K enters the cutout 114*a*, and the lower left and right projections 172K and 174K move downward in the cutouts 113*a* and 114*a*, respectively.

Shortly before the lower left and right projections 172K and 174K abut the bottoms of the cutouts 113*a* and 114*a*, respectively, the upper left projection 173K enters the left recess 113*e* and the upper right projection 175K enters the right recess 114*e*.

Once the image forming unit 171K has been mounted on the chassis 112, the image forming unit 171K is reliably supported by the chassis 112 at four locations: the lower left and right projections 172K and 174K and the upper left and right projections 173K and 175K.

Figure 8:
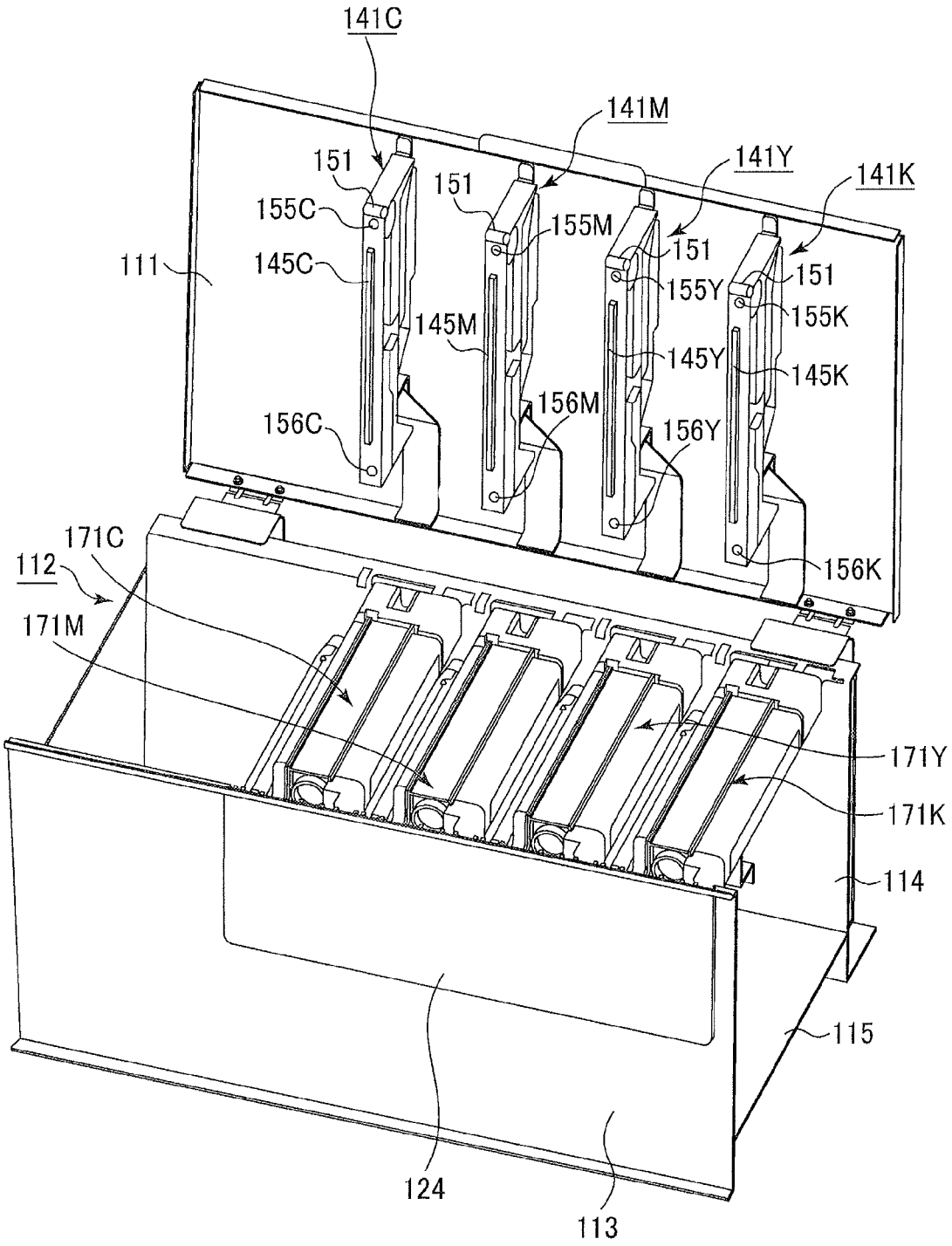
FIG. 8 is a perspective view of the image forming units, head units mounted on the top cover, and surrounding structural elements.
Figure 9:
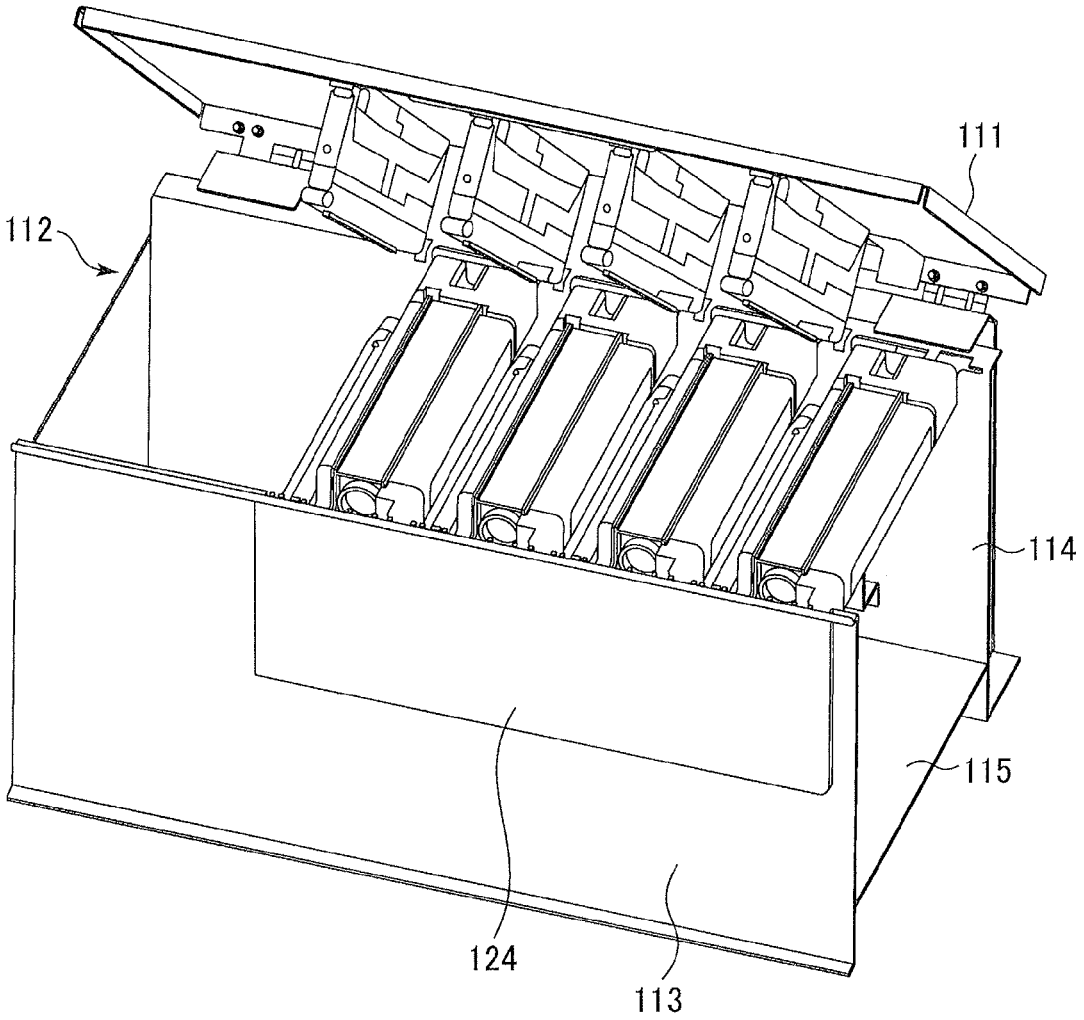
FIG. 9 is another perspective view when the top cover is opened through an angle of about 30 degrees.
Figure 10:
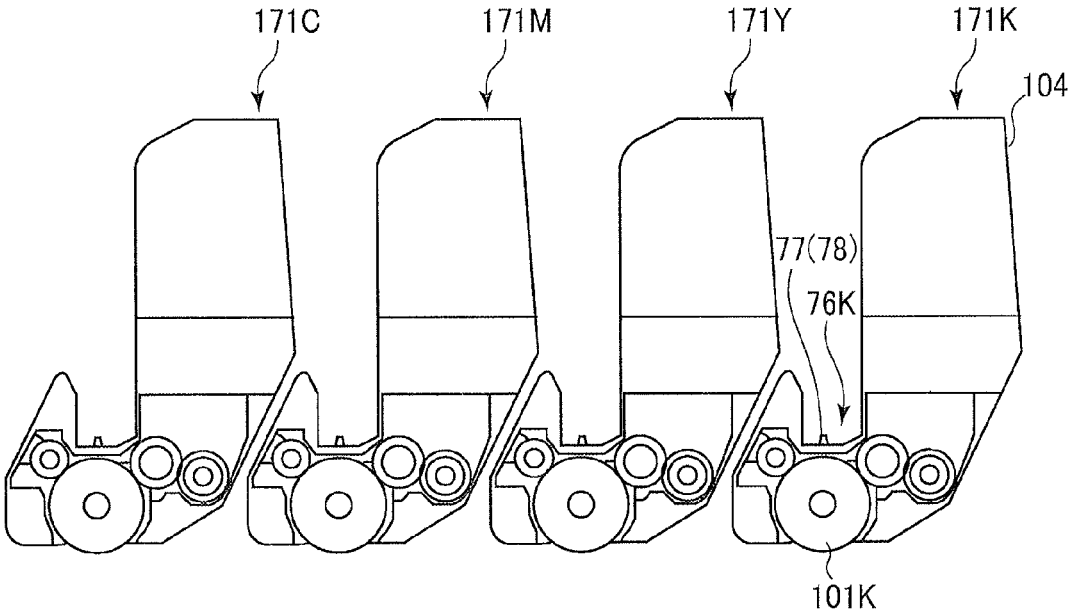
FIG. 10 illustrates the positional relationship among the image forming units when they have been attached to the chassis.

FIG. 8 is a perspective view of the image forming units 171K, 171Y, 171M, and 171C, the black, yellow, magenta, and cyan head units 141K, 141Y, 141M, and 141C mounted on the top cover 111, and surrounding structural elements. FIG. 9 is another perspective view when the top cover 111 is opened through an angle of about 30 degrees. FIG. 10 illustrates the positional relationship among the image forming units 171K, 171Y, 171M, and 171C when they have been attached to the chassis 112.

Referring to FIG. 10, the image forming unit 171K, 171Y, 171M, and 171C are aligned in a direction parallel to the axes of the pivot shafts 160, and form images of corresponding colors. The image forming unit 171K will be described by way of example. The image forming unit 171K includes a toner cartridge 104 and a photoconductive drum 101 that serves as a photoconductive body, and has a generally J-shaped cross-section. The J-shaped image forming unit 171K includes a head receiving space 176K that receives the LED head 145K therein.

Once the image forming unit 171K is mounted on the chassis 112, a gear train (not shown) is brought into a mesh engagement with the drive gear 134*a* (FIG. 2) mounted on the right frame 114, so that drive forces are transmitted to respective rotatable bodies (e.g., the photoconductive drum 101K) in the image forming unit 171K.

The image forming unit 171K extends in its longitudinal direction substantially perpendicular to the axes of the pivot shafts 160, and includes upwardly extending projections 177 and 178. The projection 177 is formed on a left end portion of the image forming unit 171K (FIG. 10), and the projection 178 is formed on a right end portion of the image forming unit 171K.

Referring to FIGS. 8 and 9, once the image forming units 171K, 171Y, 171M, and 171C are mounted on the chassis 112, they are ready to receive the LED head units 141K, 141Y, 141M, and 141C, respectively. Therefore, when the top cover 111 is closed relative to the chassis 112, the LED heads 145K, 145Y, 145M, and 145C enter the corresponding head receiving spaces 176K, 176Y, 176M, and 176C, respectively, and the projections 177K, 177Y, 177M, and 177C and 178K, 178Y, 178M, and 178C enter corresponding positioning openings 155K, 155Y, 155M, and 155C and 156K, 156Y, 156M, and 1560, respectively, formed in the bottom surface of the LED head 145K so that the LED heads 145K, 145Y, 145M, and 145C are accurately positioned.

Thus, as the top cover 111 is closed relative to the chassis 112, the head unit 141K, 141Y, 141M, and 141C gradually enter gaps defined between adjacent image forming units 171K, 171Y, 171M, and 171C and then into the corresponding head receiving spaces 176.

With reference to FIGS. 11 to 14, a description will be given of the operation of the head unit 141K when top cover 111 pivots from the open position (FIG. 2) to the closed position (FIGS. 1 and 14).

FIGS. 11 to 14 illustrate pertinent portions of the printing section 102. The LED head units 141K, 141Y, 141M, and 141C are identical in construction, and therefore the description thereof will be confined to the LED head unit 141K. The transfer unit 110, fixing unit 115, and transport roller pairs 121 and 122 (FIG. 15) are omitted from FIGS. 11 to 14 for the sake of simplicity.

The hinge 135 is fixed at one hinge leaf 135*a* to the supporting plate 131 and at the other hinge leaf 135*b* to the top cover 111. The hinge 135 is fixed by means of screws 137. Likewise, the hinge 136 is fixed to the supporting plate 132 and the top cover 111. Thus, the top cover 111 is pivotally supported by the hinges 135 and 136, so that the top cover 111 can pivot between the closed position and the open position.

Figure 11A:
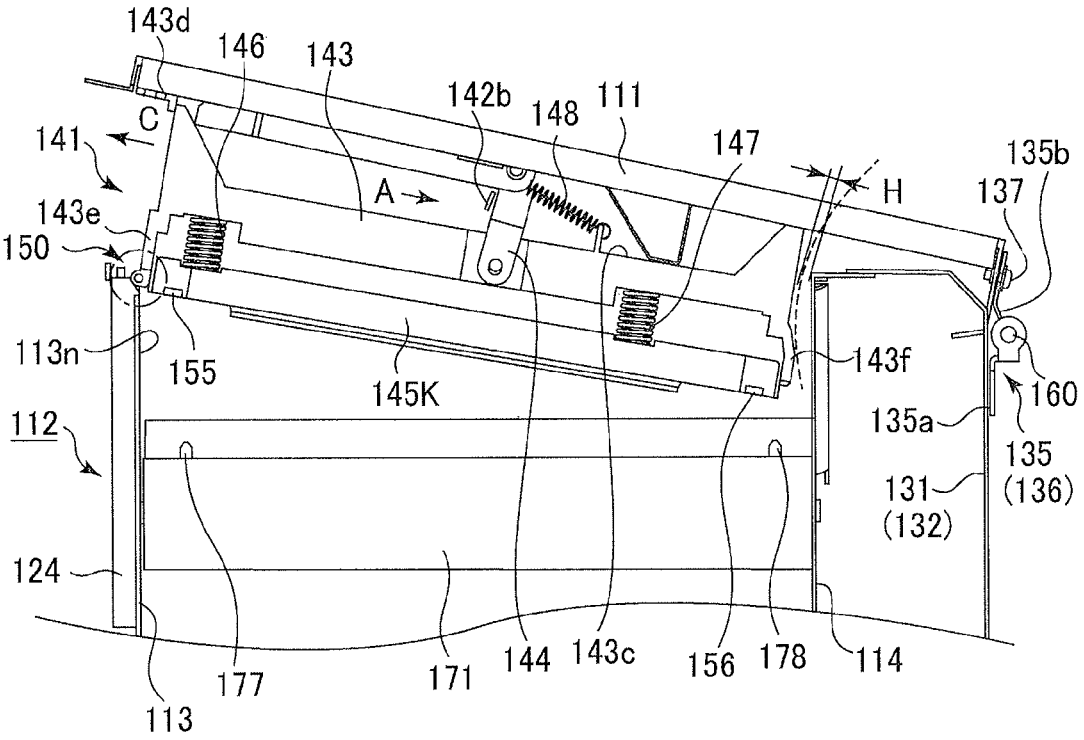
FIG. 11A illustrates the position of the top cover when a roller enters a cutout, and then abuts an inclined surface.
Figure 11B:
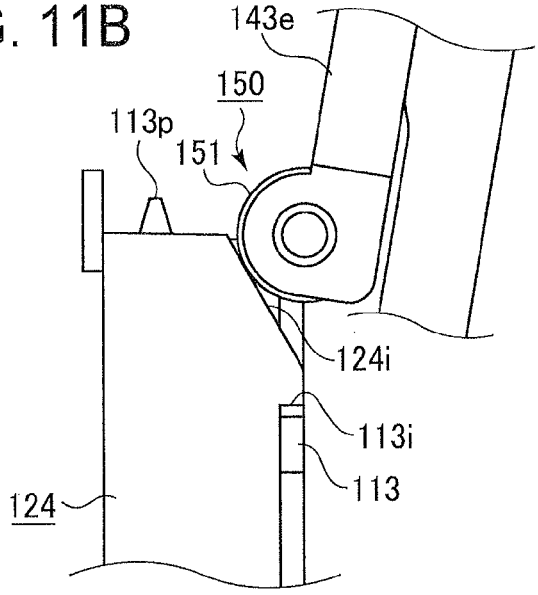
FIG. 11B is a partially expanded view of the roller.

FIG. 11A illustrates the position of the top cover 111 when the roller 151 first enters the cutout 113*i*, and then abuts the inclined surface 124*i*. FIG. 11B is a partially expanded view of the roller 151, which rolls on the inclined surface 124*i*. The inclined surface 124*i* slopes down inwardly.

Referring to FIG. 11A, the head holder 143 is urged in the C direction, and is at the reference position where the abutment portion 143*c* is in contact with the abutment portion 142*c*. The LED head 145K is urged by the compression springs 146 and 147 in such a direction as to be away from the head holder 143. The LED head 145K is stopped at the projections 145*a* by the bottom 143*h* of the groove 143*g*.

When the top cover 111 is being closed clearing the right frame 114, the right extended portion 143*f* of the head holder 143 describes a curve shown in a dotted line. It is to be noted that the distance between the right extended portion 143*f* and the corner of the right frame 114 is at least "H."

When the top cover 111 is further closed, the roller 151 moves obliquely downward while also rolling on the inclined surface 124*i*. At the same time, the head holder 143 displaces against the urging force of the tension coil spring 148 in the A direction toward the axes of the pivot shafts 160. When the top cover 111 is still further closed, the roller 151 leaves the inclined surface 124*i*, and then begins to roll on an inner surface 113*n* of the left frame 113 vertically downward, while being in a pressure contact with the inner surface 113*n*.

Figure 12A:
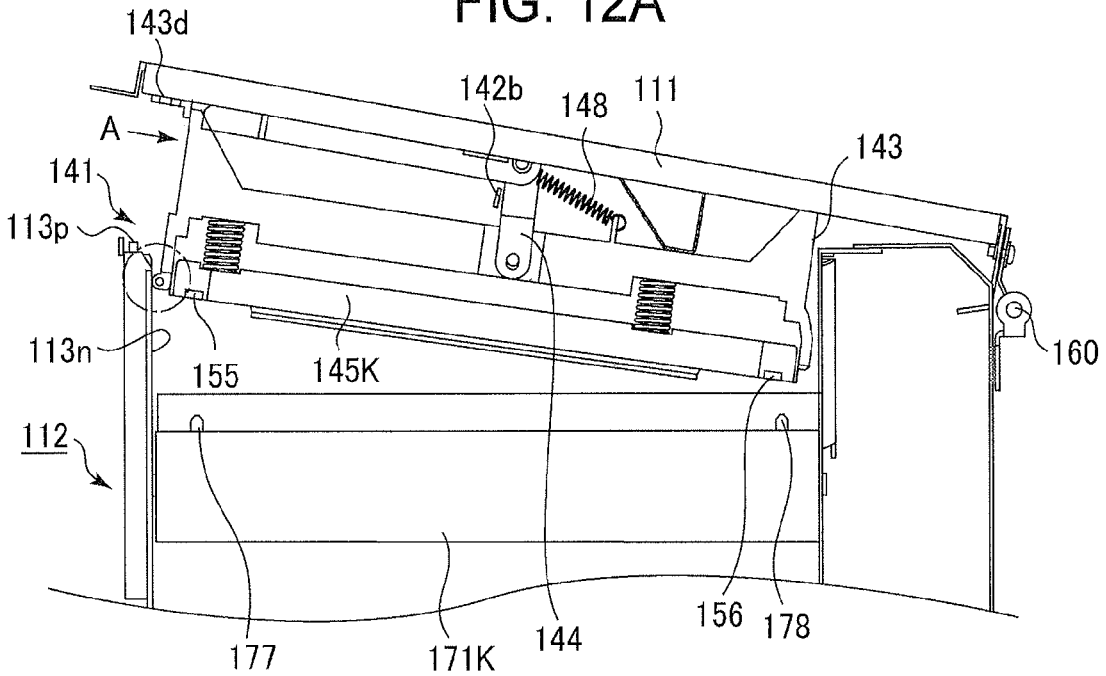
FIG. 12A illustrates the roller leaves the inclined surface and comes into pressure contact with an inner surface of the chassis.
Figure 12B:
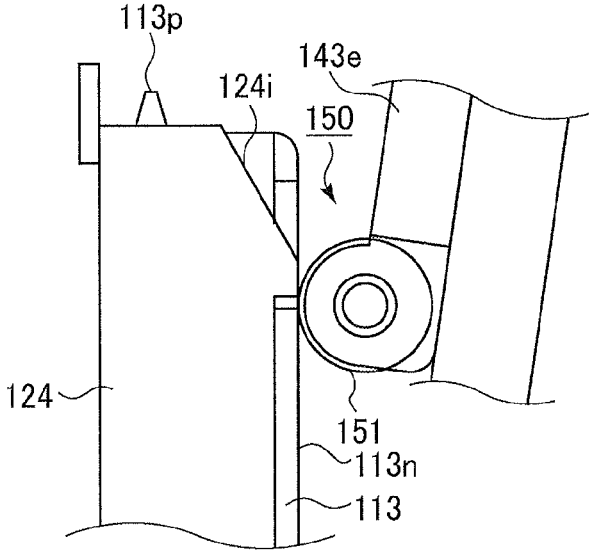
FIG. 12B is an expanded view of a pertinent, portion shown in FIG. 12A.
Figure 13:
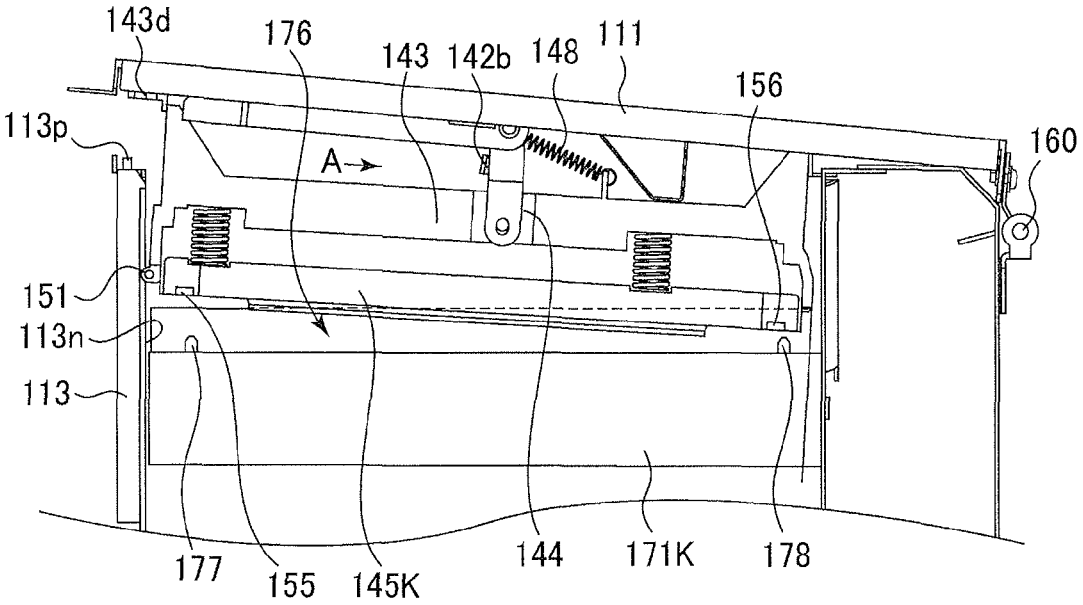
FIG. 13 illustrates the roller that rolls on the inner surface until the LED head enters the corresponding head receiving space.
Figure 14A:
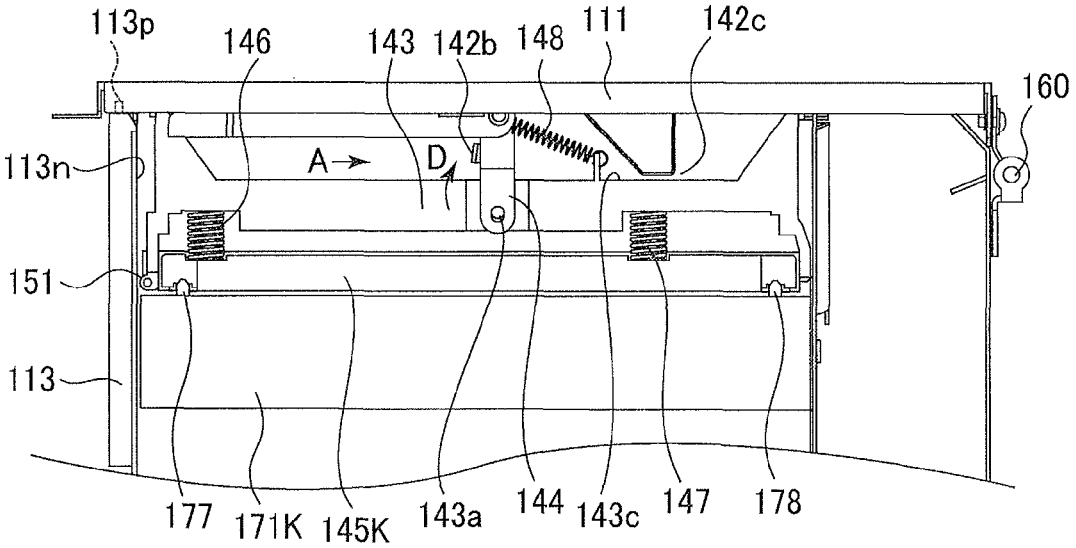
FIG. 14A illustrates when the top cover finally reaches the closed position.
Figure 14B:
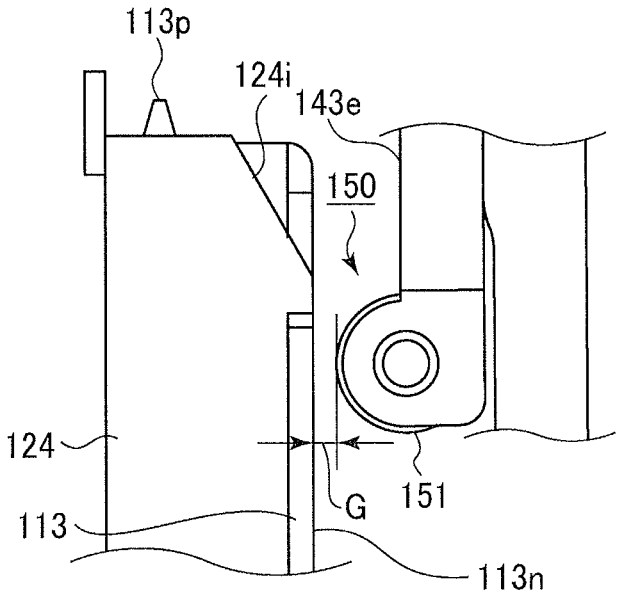
FIG. 14B illustrates the positional relation between the roller and the inner surface.

FIG. 12A illustrates the roller 151 when it leaves the inclined surface 124*i* and moves into pressure contact with an inner surface 113*n*. FIG. 12B is an expanded view of a pertinent portion shown in FIG. 12A. FIG. 13 illustrates the roller 151 that rolls on the inner surface 113*n* until the LED head 145K enters the corresponding head receiving space 176. FIG. 14A illustrates when the top cover 111 finally reaches the closed position. FIG. 14B illustrates the final positional relation between the roller 151 and the inner surface 113*n*.

When the top cover 111 is further closed from the FIG. 12A position, the roller 151 moves vertically downward along the inner surface 113*n*, while also rolling on the inner surface 113*n* in pressure contact therewith. Thus, the LED head 145K enters the corresponding head receiving space 176 as shown in FIG. 13. The positioning holes 155 and 156 are above the projections 177 and 178 formed on the longitudinal end portions in the head receiving space 176, and the positioning hole 143*d* formed in a projection of the head holder 143 is above the positioning post 113*p* (FIGS. 12-14) formed on the left frame 113. When the top cover 111 is yet further closed, the projections 177 and 178 fit into the positioning holes 155 and 156, respectively, and the top cover 111 finally reaches the closed position as shown in FIG. 14A, so that the LED head 145K is paced in position. The positioning post 113*p* fits into the positioning hole 143*d*, thereby fixing the position of the head holder 143 in the A direction and the C direction. It is to be noted that the positioning post 113*p* is in the shape of a cone or tapered projection as shown in FIG. 12B. Therefore, as the positioning hole 143*d* moves downward along the conical or tapered surface of the positioning post 113*p*, the head holder 143 is further pushed toward the axes of the shafts 160. As a result, when the top cove is completely closed, the head holder 143 takes up a position where there is a gap "G" between the roller 151 and the inner surface 113*n* as shown in FIG. 14B. It is also to be noted that the abutment portion 143*c* is not in contact with the abutment portion 142*c*. This implies that the holder 143 is pushed up by the left frame 113 and is pivoted about the projection 143*a* slightly in a direction shown by arrow D. Since the projection 145*a* of each LED head loosely fits in the grooves 143*g*, the projections 177 and 178 enter corresponding positioning openings 155 and 156, respectively, without difficulty after or at the same time that the positioning hole 143*d* completely fits over the positioning post 113*p*.

Once the top cover 111 is fixed at the closed position (FIG. 14A) by a locking means (not shown), the LED head 145K is positioned in the LED head receiving space 176 and the projection 145*a* is urged by the compression springs 146 and 147 against the bottom of the LED head receiving space 176 so that the projection 145*a* is somewhat spaced from the bottom 143*h* of the head holder 143 as shown in FIG. 5B.

During the closing operation, the head holder 143 remains at the reference position until the roller 151 abuts the inclined surface 124*i*. While the roller 151 is rolling on the inclined surface 124*i* and the inner surface 113*n* of the left frame 113, the head holder 143 slightly moves in the A direction until the top cover 111 reaches the closed position.

As shown in FIG. 14A, the position of the positioning post 113*p* relative to the positioning hole 143*d* is selected such that the conical or tapered surface of the positioning post 113*p* pushes the head holder 143 toward the axes of the shafts 160 as the top cover 111 pivots to the closed position. Therefore, the roller 151 is out of contact with the inner surface 113*n* of the left frame 113 when the top cover 111 reaches the closed position. The radius of rotation of the head holder 143 is effectively reduced by a distance W, which is the amount of displacement of the head holder 143 from the reference position in the A direction. It is to be noted that the head holder 143 is positioned relative to the top cover 111 to ensure that there is a clearance H (FIG. 11A) between the right extended portion 143*f* and the corner of the right frame 114 when the top cover 111 pivots from the open position to the closed position.

When the top cover 111 pivots from the closed position (FIG. 14A) to the open position (FIG. 11), the head holder 143 returns to the reference position before the roller 151 leaves the inclined surface 124*i*. This ensures that the top cover 111 pivots with the head unit 141K not interfering with the chassis 112 after the roller 151 leaves the inclined surface 124*i*.

Figure 15:
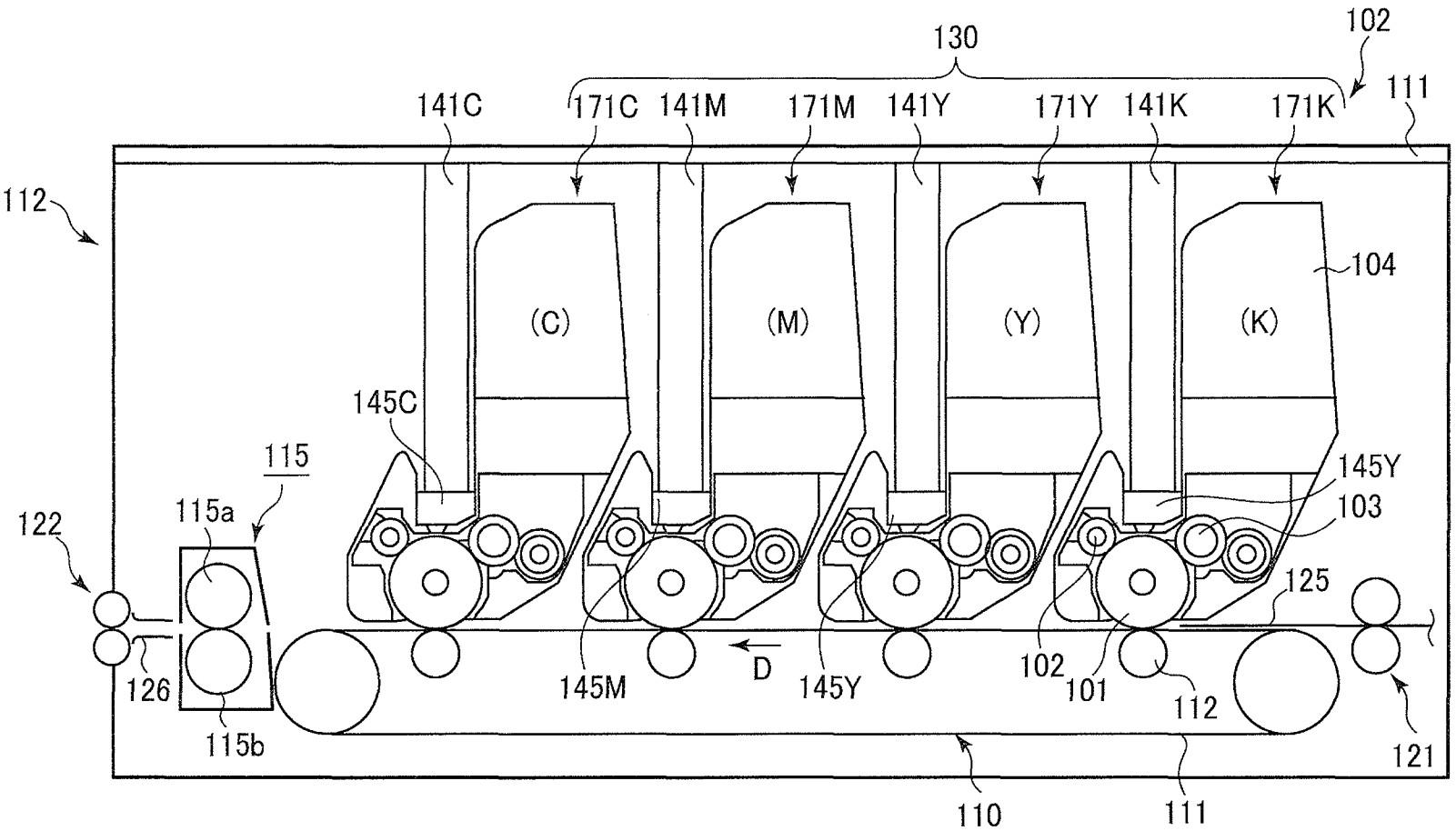
FIG. 15 illustrates portions inside a printing section when the top cover has been pivoted to the closed position with the LED heads and the head units received in corresponding receiving spaces.

FIG. 15 illustrates portions inside the printing section 102 when the top cover 111 has been pivoted to the closed position with the LED heads 145K, 145Y, 145M, and 145C and the head units 141K, 141Y, 141M, and 141C received in corresponding receiving spaces 76.

The transport roller pair 121 receives the recording paper 125 from the paper cassette 103 through the transport path, and then advances the recording paper 125 to the image forming unit 171K. The image forming units 171K, 171Y, 171M, and 171C and the LED heads 145K, 145Y, 145M, and 145C are arranged in tandem, configuring an image forming section 130 as a whole. As the recording paper 125 advances through the image forming units 171K, 171Y, 171M, and 1710, the transfer unit 110 electrostatically transfers images of corresponding colors, i.e., black (K), yellow (Y), magenta (M), and cyan (C) images, onto the recording paper 125 one over the other in registration.

The image forming units 171K, 171Y, 171M, and 171C form black, yellow, magenta, and cyan toner images, respectively, as follows: Charging rollers 102 uniformly charge the circumferential surfaces of the photoconductive drums 101. The LED heads illuminate the charged surfaces in accordance with image data to form electrostatic latent images on the corresponding photoconductive drums 101. Developing rollers 103 supply toners of corresponding colors to the electrostatic latent images to develop the electrostatic latent images into toner images, thereby forming toner images of corresponding colors.

The transfer unit 110 includes a transfer belt 111, and four transfer rollers 112. The transfer belt 111 receives the recording paper 125 from the transport roller pair 121, and transports the recording paper 125 through the image forming units 171K, 171Y, 171M, and 171C. The transfer rollers 112 are disposed to face corresponding photoconductive drums 101 with the transfer belt 111 sandwiched between the transfer rollers 112 and the photoconductive drums 101. The transfer rollers 112 transfer the toner images of corresponding colors onto the recording paper 125 one over the other in registration.

The fixing unit 115 includes a heat roller 115*a* and a pressure roller 115*b*. As the recording paper 125 passes through the nip formed between the heat roller 115*a* and pressure roller 115*b*, the toner images on the recording paper 125 are fused into the recording paper 125 under heat and pressure. A discharge roller pair 122 discharges the recording paper 125, which has left the fixing unit 115 and advanced further, to the outside of the printing section 102.

A modification to the first embodiment will be described.

Figure 16:
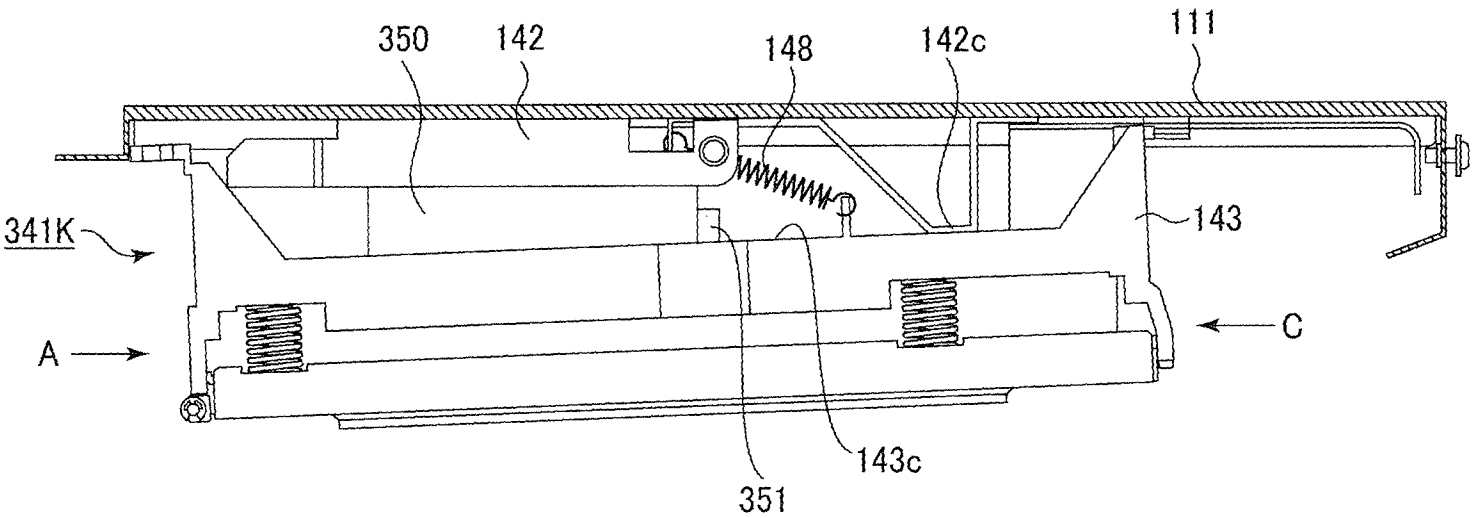
FIG. 16 illustrates a pertinent portion of a modified LED head unit, which is a modification to the LED head unit according to the first embodiment.

By way of example, FIG. 16 illustrates a pertinent portion of an LED head unit 341, which is a modification to the LED head unit 141K according to the first embodiment. The LED head unit 341 differs from the LED head unit 141K according to the first embodiment in that a guide block 350 is employed in place of the link 144 (FIG. 4). The guide block 350 is secured to a support 142, and is sandwiched between the support 142 and a head holder 143 so that an abutment surface 143*c* of the head holder 143 is slidable on the guide block 350. This configuration permits the head holder 143 to slide in a direction substantially parallel to the top cover 111.

Further, the head holder 143 includes a projection 351 that abuts the guide block 350 at the reference position of the head holder 143. A tension coil spring 148 exerts a tensile force on the head holder 143. The projection 351 serves as a stopper that prohibits the head holder 143 from moving further in a direction shown by arrow C. When the top cover 111 is pivoted from an open position to a closed position, the LED head unit 341 operates in essentially the same way as the LED head unit 141K.

In the first embodiment, while the roller 151 rolls on the inclined surface 124*i* obliquely downward, the head holder 143 is pushed and moves toward the axes of the pivot shafts 160. The present invention is not limited to the first embodiment and modification, and may be modified in a variety of ways. For example, a monitor may be employed to monitor the movement of the head holder 143, thereby driving the head holder 143 in the A direction so that the head holder 143 will not interfere with the chassis 112 when the top cover 111 pivots.

As described above, the head holder 143 is supported so that the head holder 143 can move back and forth relative to the top cover 111 in the longitudinal direction in which the head holder 143 extends. The configuration minimizes the pivot radius of the head holder 143 when the top cover 111 pivots about the pivot shafts 60 with the roller 151 rolling on the inclined surface 124*i*, thereby minimizing a space required.

Second Embodiment

Figure 17:
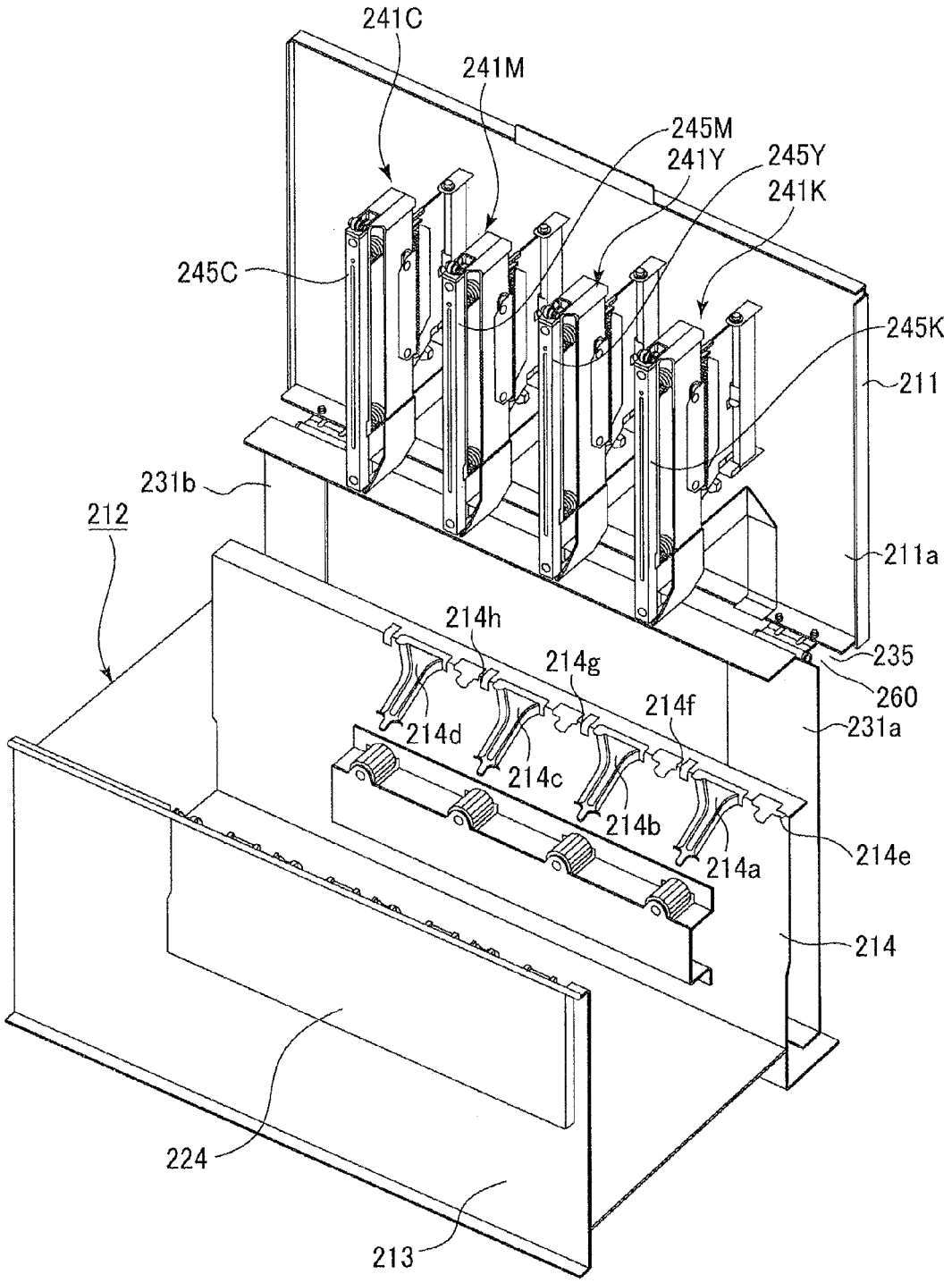
FIG. 17 is a perspective view of a body and a top cover according to a second embodiment.
Figure 18:
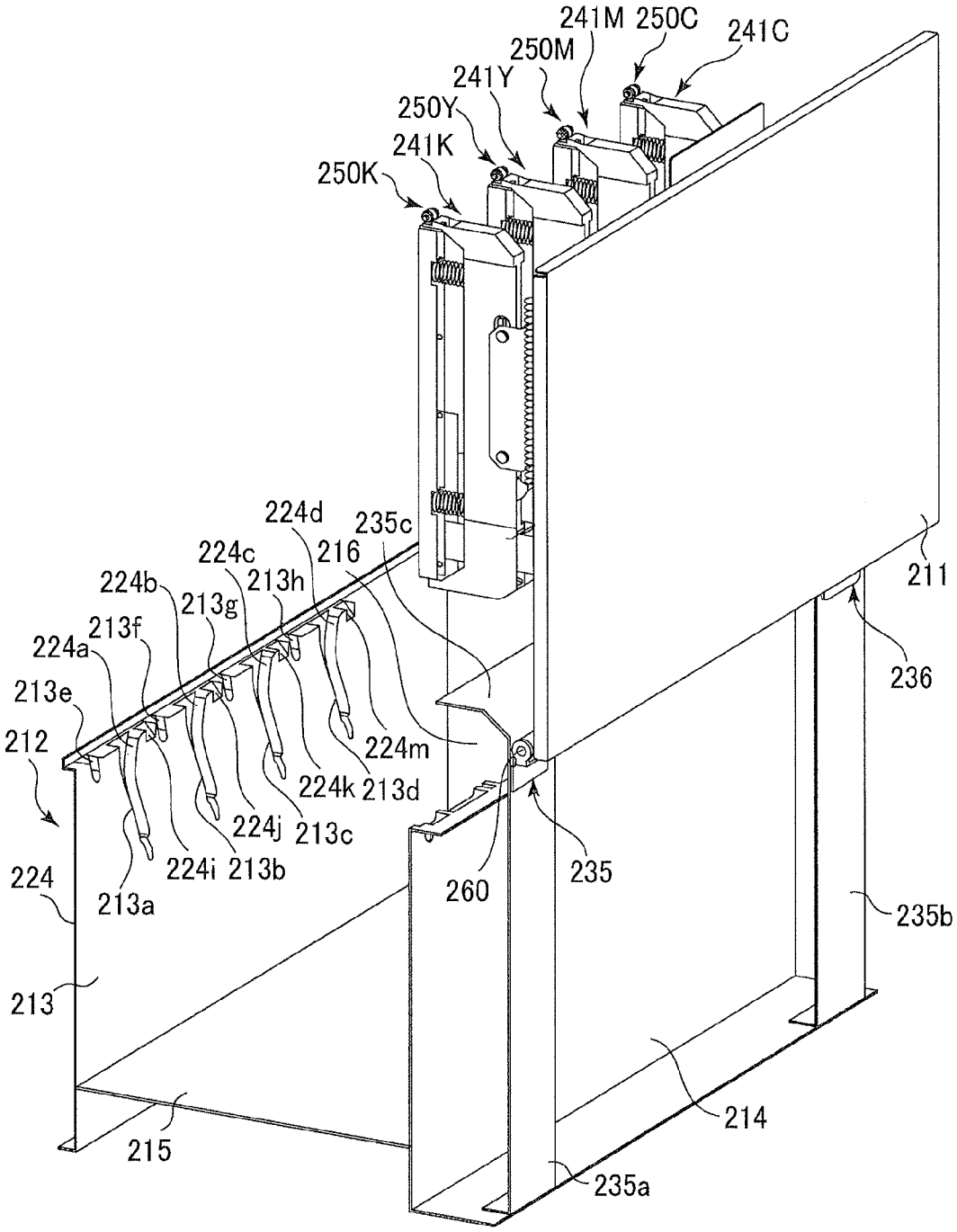
FIG. 18 is a perspective view of the body and the top cover as seen in another direction.

FIG. 17 is a perspective view of a chassis 212 and a top cover 211 that is pivotally mounted on the chassis 212. FIG. 18 is a perspective view of the chassis 212 and the top cover 211 as seen in another direction.

The second embodiment differs from the first embodiment in that head units 241K, 241Y, 241M, and 241C are mounted on the top cover 211 and a pair of generally U-shaped supporting plates 231*a* and 231*b* are assembled to the chassis 212. Thus, the second embodiment will be described only with respect to portions different from the first embodiment. The LED head units 141K, 141Y, 141M, and 141C are identical in construction and the description thereof will be confined to the LED head unit 141K.

Figure 21:
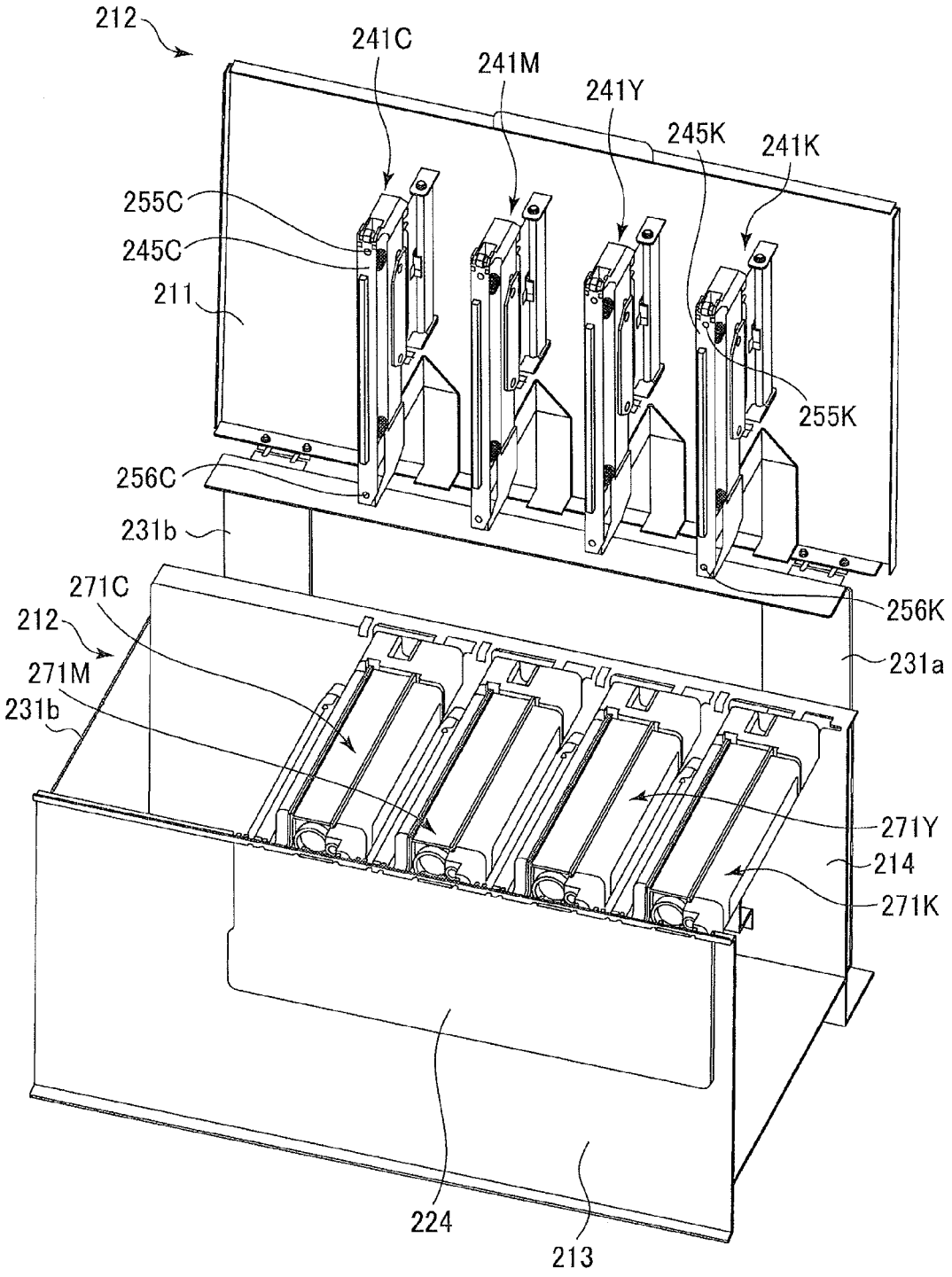
FIG. 21 is a perspective view of the image forming units, the head units mounted on the top cover, and surrounding structural elements.
Figure 22:
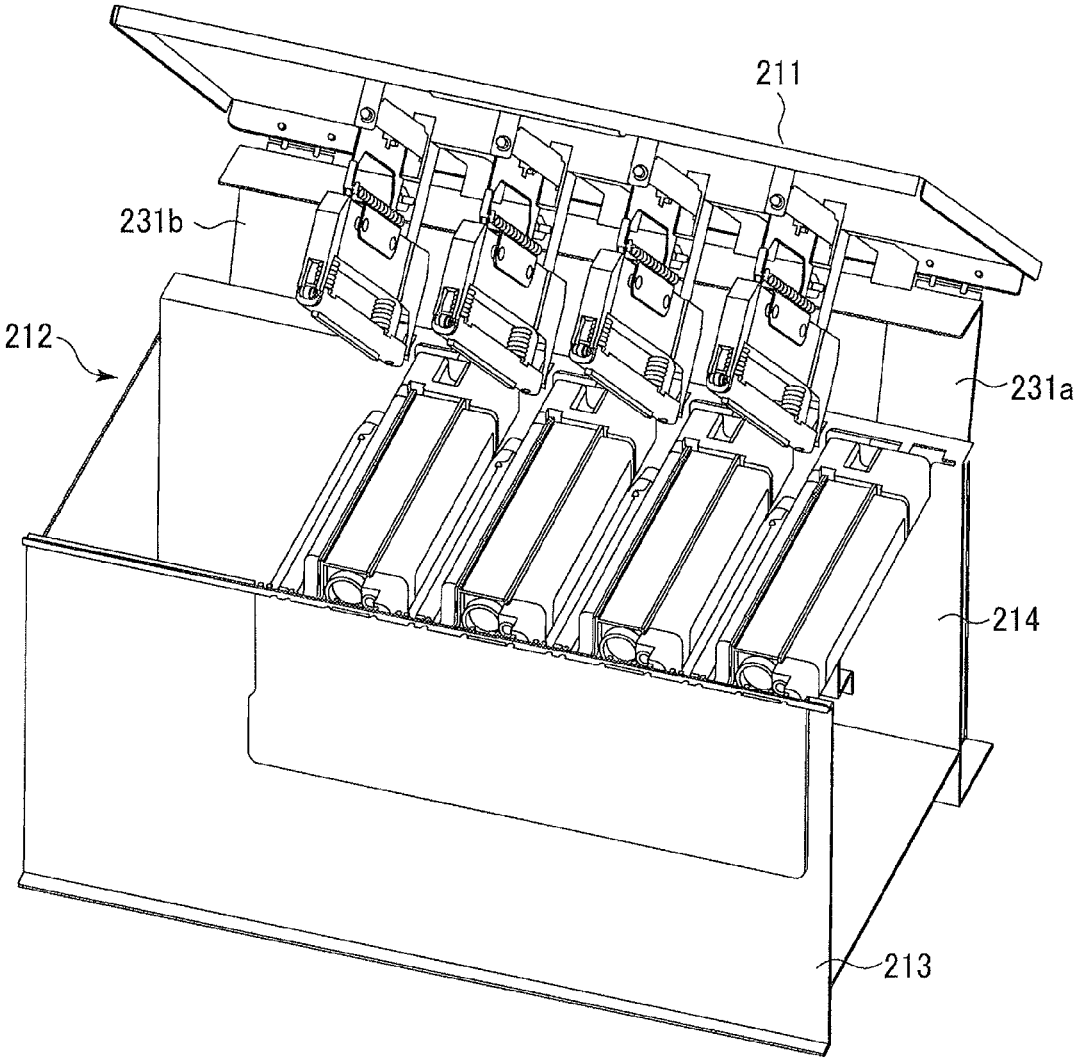
FIG. 22 is another perspective view when the top cover is opened through an angle of about 30 degrees.

Each of the supporting plates 231*a* and 231*b* is disposed at a longitudinal end portion of the outer surface of a right frame 214. The top cover 111 is pivotally mounted on the right frame 214 by means of hinges 235 and 236. Each of the hinges 235 and 236 includes two hinge leaves and a shaft 260. One of their respective hinge leaves is fixed to the supporting plate 231*a* or 231*b*, and the other is fixed to the top cover 211. The right frame 114 is also formed with engagement portions 214*e*, 214*f*, 214*g*, and 214*h* that receive the upper right projections (not shown) of image forming units 271K, 271Y, 271M, and 271C (FIGS. 21 and 22).

The top cover 211 is configured to pivot between a closed position (FIG. 26) where the top cover 211 has closed to extend horizontally and an open position (FIG. 17) where the top cover 211 has opened by 90 degrees to extend vertically. The pivot shafts 260 (FIGS. 17 and 18) of the top cover 211 are substantially parallel to the right frame 214, and are in line with each other.

The top cover 211 includes a black (K) head unit 241K, a yellow (Y) head unit 241Y, a magenta (M) head unit 241M, and a cyan (C) head unit 241C, which are mounted on the inner surface 211*a* of the top cover 211, are aligned along the axes of the shafts 260, and serve as exposing heads.

The black head unit 241K, yellow head unit 241Y, magenta head unit 241M, and cyan head unit 241C include a black (K) LED head 245K, a yellow (Y) LED head 245Y, a magenta (M) LED head, and a cyan (C) LED head 245C, respectively, which are mounted on the free ends of the black head unit 241K, yellow head unit 241Y, magenta head unit 241M, and cyan head unit 241C, respectively. The LED heads 245K, 245Y, 245M, and 245C extend in their longitudinal directions substantially perpendicular to the axes of the shafts 260 of the top cover 211, so that the lines of light emitting diodes (LEDs) of the LED heads 245K, 245Y, 245M, and 245C extend in directions substantially perpendicular to the axes of the pivot shafts 260.

One of the respective longitudinal ends of the LED heads 245K, 245Y, 245M, and 245C is closer to the axes of the shafts 60 than the other of the respective longitudinal ends of the LED heads.

As described later, the four head units 241K, 241Y, 241M, and 241C include roller assemblies 250K, 250Y, 250M, and 250C, respectively, at one of their respective free end corners. The guide plate 224 is formed with four inclined surfaces 224*i*, 224*j*, 224*k*, and 224*m* which receive the roller assemblies 250K, 250Y, 250M, and 250C, respectively. The left frame 213 is formed with four cutouts (not shown) similar to those 113*i*, 113*j*, 113*k*, and 113*m* shown in FIG. 7, which are in alignment with the inclined surfaces 224*i*, 224*j*, 224*k*, and 224*m* and receive the roller assemblies 250K, 250Y, 250M, and 250C, respectively.

Figure 19:
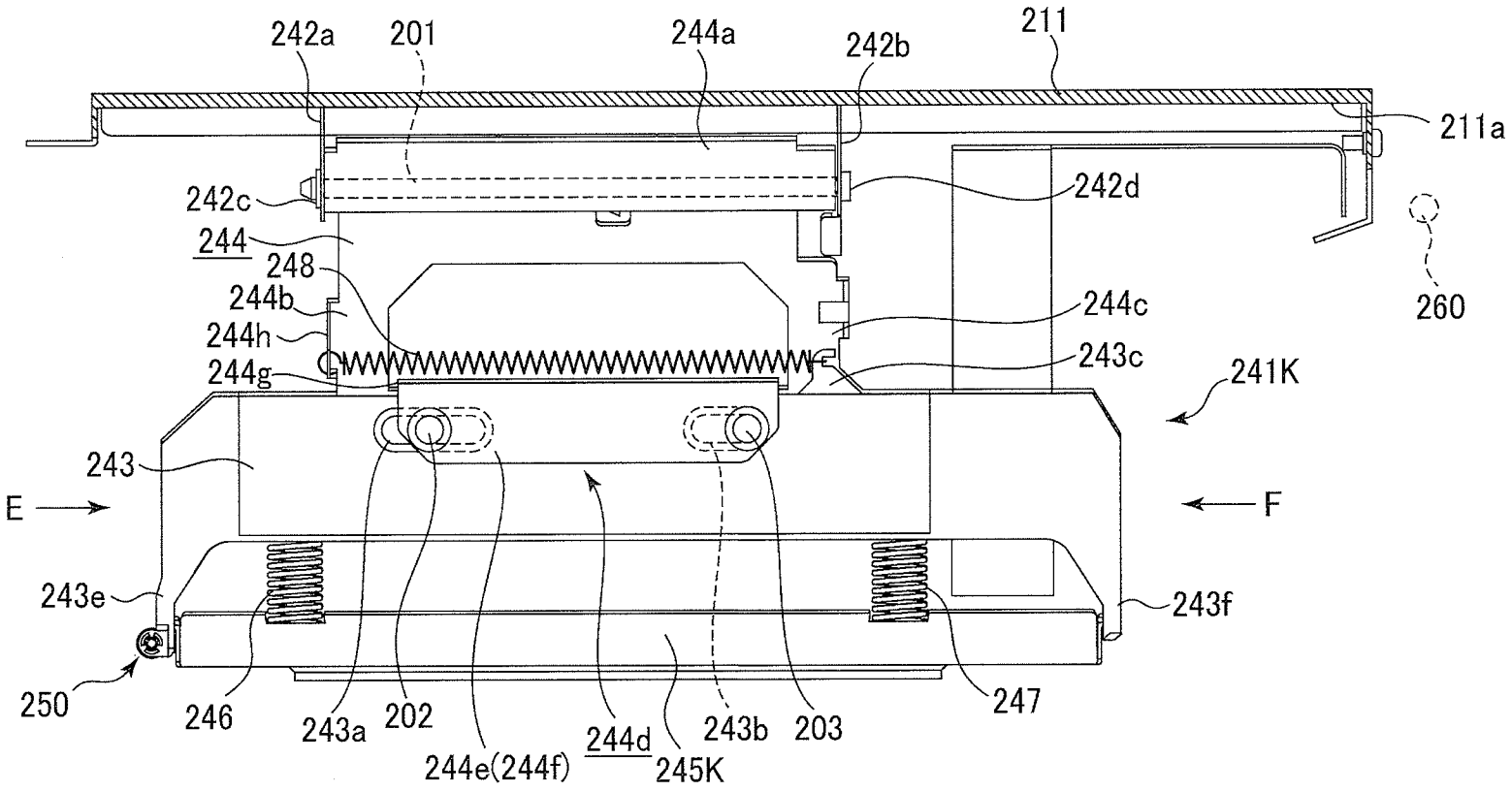
FIG. 19 is a front view of the top cover and an LED head unit according to the second embodiment as seen in a direction shown by arrow X in FIG. 1 when the top cover is at the closed position.

FIG. 19 is a front view of the top cover 211 and the LED head unit 241K as seen in a direction shown by arrow X in FIG. 1 when the top cover 211 is at the closed position. The LED head units 241K, 241Y, 241M, and 241C are identical in construction and the description thereof will be confined to the LED head unit 241K.

Referring to FIG. 19, a pair of hanging plates 242*a* and 242*b* are fixed to an inner surface 211*a* of the top cover 211. The hanging plate 242*a* includes a suspended portion 242*c* and the hanging plate 242*b* includes a suspended portion 242*d*. A shaft 201 is supported across the suspended portions 242*c* and 242*d*, and lies in a plane substantially parallel to the inner surface 211*a* of the top cover 211. A supporting member 244 is swingably supported on the shaft 201.

A support 244 includes a base 244*a* through which the shaft 201 extends, a pair of extensions 244*b* and 244*c* that extend from the base 244*a* in directions away from the shaft 201, and a U-shaped holder guide 244*d* (FIG. 20A) formed as a single piece with the extensions 244*b* and 244*c*.

The holder guide 244*d* is generally U-shaped, including side plates 244*e* and 244*f* and a connection plate 244*g* that connects the side plates 244*e* and 244*f* together. The holder guide 244*d* extends in a direction substantially perpendicular to the shaft 201. The holder guide 244*d* includes two rods 202 and 203 that are supported by the side plates 244*e* and 244*f*. A head holder 243 is loosely sandwiched between the side plates 244*e* and 244*f*. The rods 202 and 203 extend parallel to the axes of the shafts 260, and extend through elongate holes 243*a* and 243*b* formed in the head holder 243. The elongated holes 243*a* and 243*b* are elongated in a direction in which the head holder 243 is movable toward and away from the axes of the shafts 260. The rod 203 is closer to the axes of the shafts 260 than the rod 202.

The hanging plates 242*a* and 242*b* and support 244 constitute a supporting mechanism that supports the head holder 243.

The head holder 243 extends in a longitudinal direction thereof and lies in a plane substantially normal to the axes of the shaft 260. The head holder 243 is guided by the elongate holes 243*a* and 243*b* and the rods 202 and 203 which extend through the elongate holes 243*a* and 243*b*, so that the head holder 243 is movable straightly relative to the holder guide 244*d* toward and away from the axes of the shaft 260.

The suspended portion 244*b* includes a hook 244*h* at a free end portion thereof, and the head holder 243 includes a hook 243*c*. A tension coil spring 248 is disposed across the hook 244*h* and hook 243*c*.

The tension coil spring 248 pulls the hook 243*c* in such a direction as to be away from the axes of the shaft 260, so that the rod 202 abuts the head holder 243 at a longitudinal end of the elongate hole 243*a* closer to the axes of the shafts 260 and the rod 203 abuts the head holder 243 at a longitudinal end of the elongate hole 243*b* closer to the axes of the shaft 260. The position of the head holder 243, shown in FIG. 4, relative to the top cover 211 is referred to as a reference position in the second embodiment.

When the head holder 243 is at the reference position, if an external force is exerted to the head holder 243 in a direction shown by arrow E, the head holder 243 moves against the tension force of the spring 248 in the E direction, while being supported by the support 244.

When the external force is removed, the head holder 243 returns to the reference position. As described above, the head holder 243 is adapted to move in the plane substantially normal to the axes of the shaft 260 toward and away from the axes of the shafts 260.

The head holder 243 includes a left leg 243*e* and a right leg 243*f*, which cooperate with each other to hold an LED head 245K therebetween so that the LED head 245K extends in a longitudinal direction substantially parallel to the head holder 243. Thus, the LED head 245K also extends in the plane substantially normal to the axes of the shaft 260 and parallel to the top cover 211.

The image forming apparatus 101 is capable of performing monochrome printing, in which case some of the image forming units 271K, 271Y, 271M, and 271C, if not required in a particular printing operation, are lifted up from their mounting positions. For this reason, the head units 241K, 241Y, 241M, and 241C are rotatable on the shaft 201. However, a detail description is omitted.

FIG. 20A is a partial perspective view of the roller assembly 250K, which is supported at a tip portion of the left extended portion 243*e*. FIG. 20B is an expanded perspective view of a pertinent portion of the configuration shown in FIG. 20A. FIG. 20C is a cross-sectional view taken along a line 20C-20C in FIG. 20B.

Referring to FIGS. 20A and 20B, the LED head 245K includes a projection 245*a* formed at each longitudinal end portion thereof, the projection 245*a* loosely fitting in the groove 243*g*.

Thus, the LED head 245K is slightly movable in the longitudinal direction perpendicular to the axes of the pivot shafts 260 and in the plane normal to the top cover 211. A compression coil spring 246 or 247 (FIG. 4) is disposed at each longitudinal end portion, being positioned between the head holder 143 and the LED head 245K, so that the LED head 245K is in pressure contact with a bottom 243*h* of the groove 243*g* when the top cover 211 is not at the closed position.

FIG. 20A illustrates the top cover 211 at its closed position where the LED head 245K is placed in position relative to the image forming unit 271K and thus the projection 245*a* is away from the bottom 243*h* as shown in FIG. 20B.

As shown in FIGS. 20B and 20C, the roller assembly 250K includes a roller 251 rotatably mounted on a shaft 252, which in turn is supported by substantially cylindrical bearing members 250*a* and 250*b* and extends in a direction substantially parallel to the axes of the pivot shafts 260.

The shaft 252 is formed with a circumferential grooves at its longitudinal end portions. E-rings 253 are mounted to the circumferential grooves, preventing pull-out of the shaft 252. The outer diameter of the roller 251 is larger than that of the bearing members 250*a* and 250*b*, so that the roller 251 extends radially outwardly than the bearing members 250*a* and 250*b*. Thus, the circumferential surface of the roller 251 projects outwardly from the bearing members 250*a* and 250*b*. When the top cover 211 pivots to the closed position, the roller 251 rolls on the inclined surface 224*i* (FIG. 23B), the LED head 245K being pushed slightly toward the axes of the shafts 260.

FIG. 21 is a perspective view of the image forming units 271K, 271Y, 271M, and 271C, the black, yellow, magenta, and cyan head units 241K, 241Y, 241M, and 241C mounted on the top cover 211, and surrounding structural elements. FIG. 22 is another perspective view when the top cover 211 is opened through an angle of about 30 degrees.

As is illustrated in FIGS. 20A-20C and 21, the image forming units 271K, 271Y, 271M, and 271C are positioned in correspondence with the head units 241K, 241Y, 241M, and 241C, respectively.

With reference to FIGS. 23A-23B, 24A-24B, 25 and 26, a description will be given of the operation of the head unit 241K when top cover 211 pivots from the open position to the closed position.

FIGS. 23A-23B, 24A-24B, 25 and 26 illustrate pertinent portions of the printing section 202. The LED head units 241K, 241Y, 241M, and 241C are identical in construction, and therefore the description thereof will be confined to the LED head unit 241K. The transfer unit, fixing unit, and transport roller pairs similar to those shown in FIG. 15 are omitted from FIGS. 23 to 26 for the sake of simplicity.

The hinge 235 is fixed at one hinge leaf 235*a* to the supporting plate 231*a* and at the other hinge leaf 235*b* to the top cover 211. The hinge 235 is fixed by means of screws 237. Likewise, the hinge 236 is fixed to the supporting plate 231*b* and the top cover 211. Thus, the top cover 211 is pivotally supported by the hinges 235 and 236, so that the top cover 211 can pivot between the closed position and the open position.

Figure 23A:
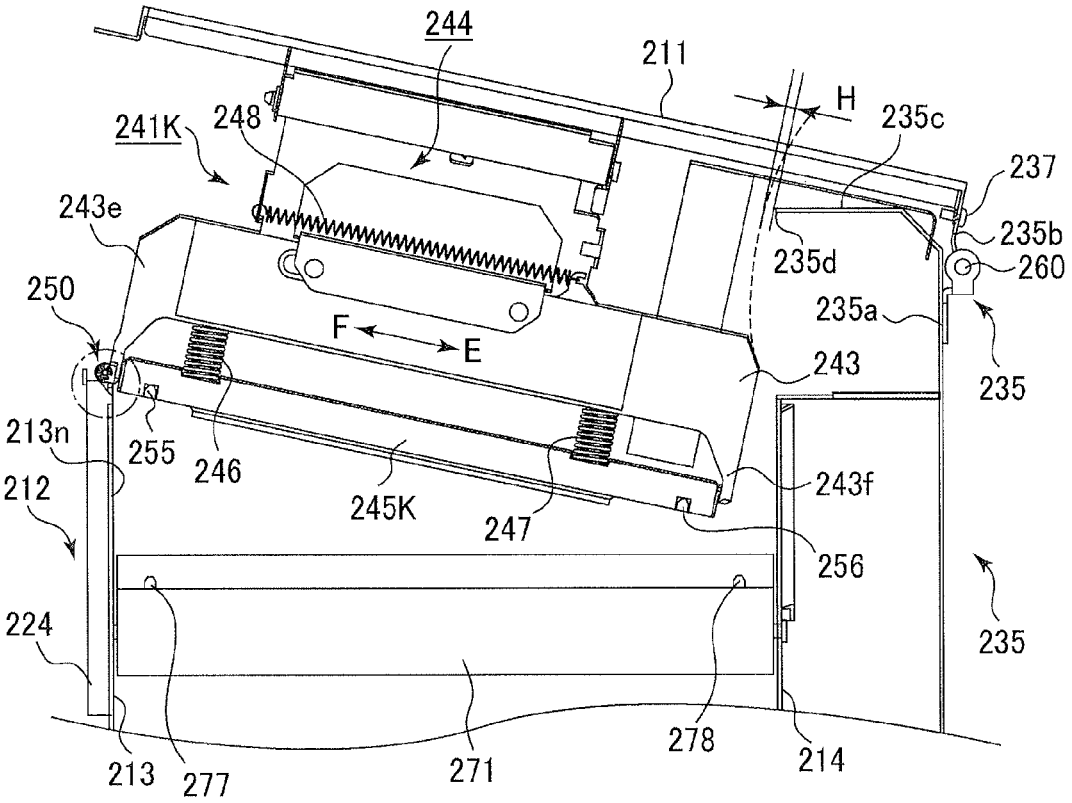
FIG. 23A illustrates the rotational position of the top cover when the roller first enters a cutout, and then abuts an inclined surface.
Figure 23B:
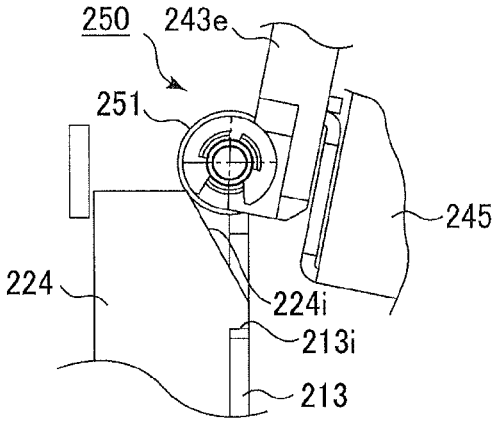
FIG. 23B is a partially expanded view of the roller, which rolls on the inclined surface.

FIG. 23A illustrates the position of the top cover 211 when the roller 251 first enters the cutout 213*i*, and then abuts the inclined surface 224*i*. FIG. 23B is a partially expanded view of the roller 251, which rolls on the inclined surface 224*i*. The inclined surface 224*i* slopes down inwardly.

Referring to FIG. 23A, the head holder 243 is at the reference position where the LED head 245K is urged by the compression springs 246 and 247 in such a direction as to be away from head holder 243. The projection 245*a* of the LED head 245K is stopped by the bottoms 243*h* of the groove 243*g* and 243*f*.

When the top cover 211 is being closed clearing the right frame 214, the locus of the right extended portion 243*f* of the head holder 243 describes a curve shown in a dotted line. It is to be noted that the distance between the right extended portion 243*f* and the tip end of 235*d* of an extended portion 235*c* is at least "H".

When the top cover 211 is further closed, the roller 251 moves obliquely downward while also rolling on the inclined surface 224*i*. At the same time, the head holder 243 displaces against the urging force of the tension coil spring 248 in the E direction toward the axes of the pivot shafts 260. When the top cover 211 is still further closed, the roller 251 leaves the inclined surface 224*i*, and then reaches an inner surface 213*n* of the left frame 213 extending vertically downward. The roller 251 is in a pressure contact with the inner surface 213*n*.

Figure 24A:
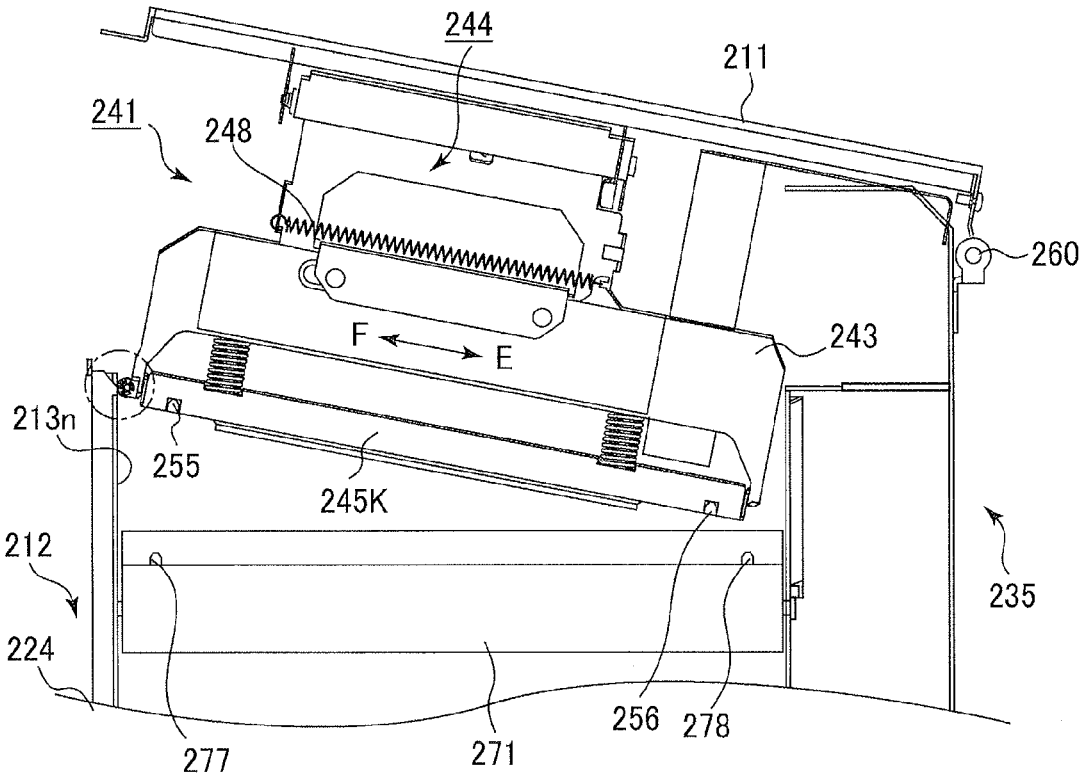
FIG. 24A illustrates the roller when it leaves the inclined surface and then comes into pressure contact with an inner surface of a left frame.
Figure 24B:
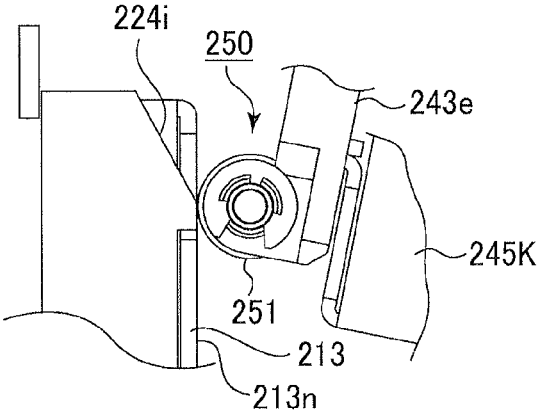
FIG. 24B is an expanded view of a pertinent portion shown in FIG. 24A.
Figure 25:
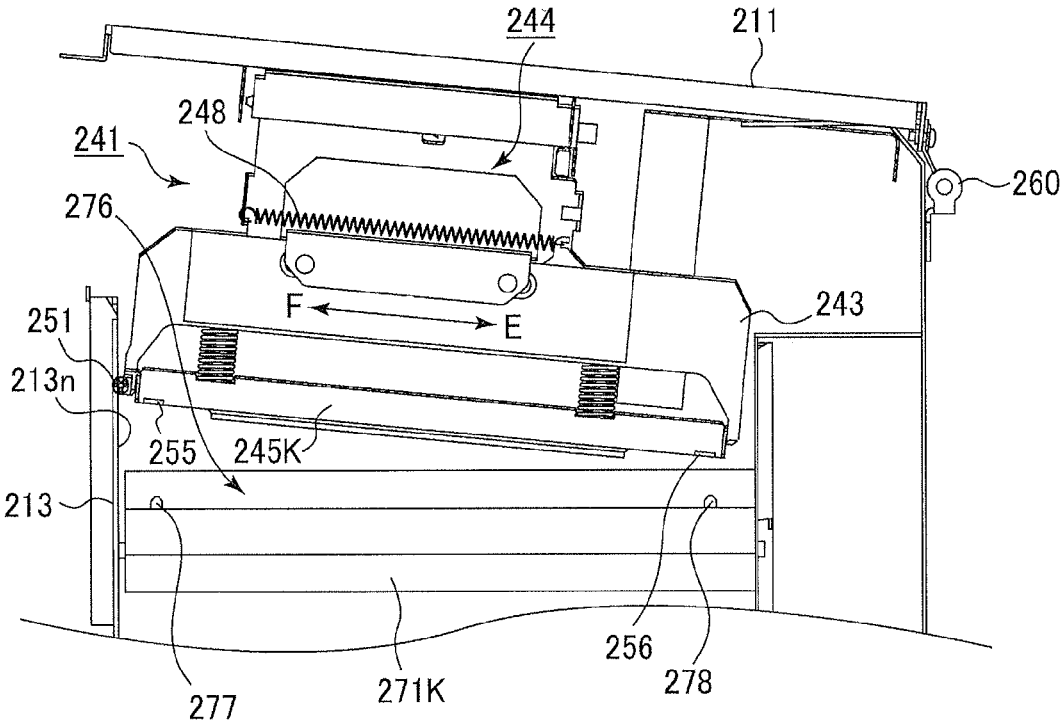
FIG. 25 illustrates the roller that rolls on the inner surface until the LED head enters a corresponding head receiving space.
Figure 26:
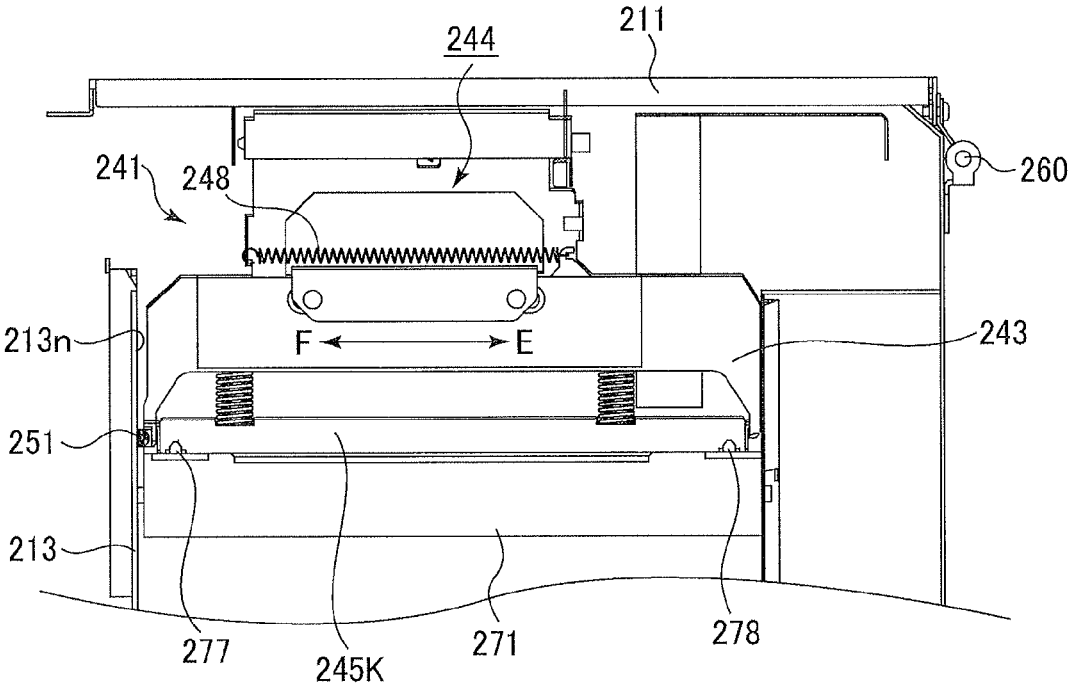
FIG. 26 illustrates when the top cover finally reaches the closed position.

FIG. 24A illustrates the roller 251 when it leaves the inclined surface 224*i* and then comes into pressure contact with an inner surface 213*n*. FIG. 24B is an expanded view of a pertinent portion shown in FIG. 24A. FIG. 25 illustrates the roller 251 that rolls on the inner surface 213*n* until the LED head 245K enters the corresponding head receiving space. FIG. 26 illustrates the top cover 211 when it has finally reached the closed position.

When the top cover 211 is further closed from the FIG. 24A position, the roller 251 moves vertically downward along the inner surface 213*n*, while also rolling on the inner surface 213*n* in pressure contact therewith. Thus, the LED head 245K enters the corresponding head receiving space 276 as shown in FIG. 25. The positioning holes 255 and 256 are above the projections 277 and 278 formed on the longitudinal end portions in the head receiving space 276.

When the top cover 211 is yet further closed, the projections 277 and 278 fit into the positioning holes 255 and 256, respectively, and the top cover 211 finally reaches the closed position as shown in FIG. 26, so that the LED head 245 is paced in position.

As described above, once the top cover 211 has been fixed by a locking means (not shown) at the closed position shown in FIG. 26, the LED heads 245K, 245Y, 245M, and 245C are placed in position in their corresponding head receiving spaces 276K, 276Y, 276M, and 276C. Specifically, the projection 245*a* formed at each longitudinal end portion of the LED head loosely fits in the grooves 243*g*, while being somewhat raised from the bottoms 243*h*. The LED heads 245K, 245Y, 245M, and 245C are urged against the bottoms of the head receiving spaces 276 by the corresponding compression coil springs 246 and 247.

When the top cover 211 is being closed, the head holder 243 remains at the reference position without interfering the chassis 212 as shown in FIG. 23A until the roller 251 begins to roll on the inclined surface 224*i*. While the roller 251 rolls on the inclined surface 224*i* and then on the inner surface 213*n*, the head holder 243 is pushed in a direction shown by arrow E toward the closed position.

When the top cover 211 pivots from the closed position to the open position, the head holder 243 moves gradually to the reference position while the roller 251 rolls on the inner surface 213*n* and then on the inclined surface 224*i*. Once the roller 251 reaches the top of the inclined surface 224*i*, the head holder 243 is at the reference position. The top cover 211 then pivots to the open position so that the head holder 243 clears any part of the image forming apparatus.

As described above, the image forming apparatus according to the second embodiment is configured such that the head holder 243 is movable relative to the top cover 211 in the longitudinal direction thereof parallel to the top cover 211. Therefore, when the top cover 211 pivots, the radius of rotation of the head holder 243 is effectively reduced, minimizing the space required for the head holder 243 to pivot and hence implementing a compact image forming apparatus.

The first and second embodiments have been described with respect to a color electrophotographic printer. The present invention may also be applied to other types of image forming apparatus including a copying machine, a facsimile machine, and a multi-function printer (MFP), which perform an electrophotographic process to print images on a print medium. The present invention is applicable not only to a color printer but also to a monochrome printer.

The invention being thus described, it will be obvious that the same may be varied in many ways. Such variations are not to be regarded as a departure from the scope of the invention, and all such modifications as would be obvious to one skilled in the art are intended to be included within the scope of the following claims.

What is claimed is:

1. An image forming apparatus comprising:

a cover configured to pivot about an axis between an open position and a closed position relative to the image forming apparatus; and a mechanism comprising:

an image forming unit that forms an image and extends in a longitudinal direction thereof substantially perpendicular to the axis;

an exposing unit that longitudinally extends in a first direction substantially perpendicularly to the axis, and is movable in the first direction along an image forming section, the exposing unit including a first longitudinal end portion and a second longitudinal end portion located on a side of the exposing unit opposite the first longitudinal end portion, the first longitudinal end portion being closer to the axis than the second longitudinal end portion, the exposing unit operating in accordance with image data, so that the image forming unit forms the image; and a supporting mechanism that is mounted on the cover and supports the exposing unit so that the exposing unit is movable relative to the cover, wherein when the cover is closed, the exposing unit moves toward the axis, so that the exposing unit is positioned in a place relative to the image forming section.

2. The image forming apparatus according to claim 1, wherein the mechanism includes a plurality of mechanisms.

3. The image forming apparatus according to claim 1, wherein the exposing unit includes a movable member that includes an engagement portion formed at the second longitudinal end portion of the exposing unit; and wherein the supporting mechanism includes;

(i) a fixed member secured to the cover, and (ii) a link including a first longitudinal end portion pivotally coupled to the movable member and a second longitudinal end portion pivotally coupled to the fixed member, and (iii) an urging member disposed across the fixed member and the movable member so that a portion of the movable member is urged against a portion of the fixed member and the movable member is urged in a direction away from the axis.

4. The image forming apparatus according to claim 1, wherein the exposing unit includes a movable member that includes an engagement portion formed at the second longitudinal end portion of the movable member; and wherein the supporting mechanism includes:

(i) a fixed member secured to the cover, and (ii) at least one first coupling portion formed on one of the fixed member and the movable member.

(iii) at least one second coupling portion of one of the fixed member and the movable member, and (iv) an urging member disposed across the fixed member and the movable member, the urging member urging the movable member in a direction away from the axis.

5. The image forming apparatus according to claim 1, wherein the exposing unit includes a movable member that includes an engagement portion formed at the second longitudinal end portion of the exposing unit, wherein the image forming apparatus further comprises a guide surface formed on a chassis of the image forming apparatus and inclined relative to the first direction, and wherein when the cover is closed relative to the image forming apparatus, the guide surface abuts the engagement portion and guides the engagement portion toward the axis.

6. The image forming apparatus according to claim 3 further comprising a guide surface formed on a chassis of the image forming apparatus and inclined relative to the first direction, wherein when the cover is closed relative to the image forming apparatus, the guide surface abuts the engagement portion and guides the engagement portion toward the axis.

7. The image forming apparatus according to claim 3, wherein the engagement portion includes a roller that rolls on the guide surface when the cover is closed relative to the image forming apparatus.

8. The image forming apparatus according to claim 3, wherein the fixed member includes a portion against which the movable member is urged and on which the movable member is slidable.

9. The image forming apparatus according to claim 3, wherein the link is coupled to the movable member so that the movable member is swingable relative to the link.

10. The image forming apparatus according to claim 3, wherein when an external force pushes the second longitudinal end portion toward the axis in the first direction, the movable member moves to a first position, and when the external force is removed from the second longitudinal end portion, the movable member moves to a second position further away from the axis than the first position.

11. The image forming apparatus according to claim 4, wherein the at least one first coupling portion is an elongate opening and the at least one second coupling portion is a rod, the elongate opening being elongated in a direction perpendicular to the axis and the rod extends through the elongate opening.

12. The image forming apparatus according to claim 5, wherein the engagement portion includes a roller that rolls on the guide surface when the cover is closed relative to the image forming apparatus.

13. The image forming apparatus according to claim 5, further comprising a fixed member secured to the cover, wherein the fixed member includes a portion against which the movable member is urged and on which the movable member is slidable.

14. The image forming apparatus according to claim 6, wherein the chassis further comprises a first positioning portion and the movable member includes a second positioning portion; and wherein when the cover is closed completely, the first positioning portion engages the second positioning portion to place the movable member in position.

15. The image forming apparatus according to claim 14, wherein when the cover is closed completely, the movable member is at a position such that a roller is spaced from the chassis by a gap.

* * * * *